US012471621B2

(12) United States Patent
Sakurai et al.

(10) Patent No.: US 12,471,621 B2
(45) Date of Patent: Nov. 18, 2025

(54) NON-COMBUSTIBLE HEATING-TYPE SMOKING ARTICLE AND ELECTRIC HEATING-TYPE SMOKING SYSTEM

(71) Applicant: JAPAN TOBACCO INC., Tokyo (JP)

(72) Inventors: Toru Sakurai, Tokyo (JP); Kenichi Iwanaga, Tokyo (JP); Noriko Osawa, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 768 days.

(21) Appl. No.: 17/244,427

(22) Filed: Apr. 29, 2021

(65) Prior Publication Data

US 2021/0244084 A1 Aug. 12, 2021

Related U.S. Application Data

(63) Continuation of application No. PCT/JP2018/045101, filed on Dec. 7, 2018.

(51) Int. Cl.

| | |
|---|---|
| ***A24D 1/20*** | (2020.01) |
| ***A24B 3/14*** | (2006.01) |
| ***A24D 1/02*** | (2006.01) |
| ***A24D 1/04*** | (2006.01) |
| ***A24F 40/20*** | (2020.01) |

(52) U.S. Cl.

CPC ..... *A24D 1/20* (2020.01); *A24B 3/14* (2013.01); *A24D 1/027* (2013.01); *A24D 1/045* (2013.01); *A24F 40/20* (2020.01)

(58) Field of Classification Search

None

See application file for complete search history.

(56) References Cited

U.S. PATENT DOCUMENTS

| | | | | |
|---|---|---|---|---|
| 4,962,773 | A | 10/1990 | White et al. | |
| 5,551,451 | A | 9/1996 | Riggs et al. | |
| 2004/0154630 | A1 | 8/2004 | Tabuchi et al. | |
| 2005/0016549 | A1* | 1/2005 | Banerjee | C09K 5/18 131/194 |
| 2006/0011206 | A1 | 1/2006 | Clarke | |
| 2011/0192408 | A1 | 8/2011 | Inagaki et al. | |

(Continued)

FOREIGN PATENT DOCUMENTS

| | | | | |
|---|---|---|---|---|
| BR | 0307705 A | * | 1/2005 | |
| CA | 2925645 C | * | 4/2018 | A24D 3/17 |

(Continued)

OTHER PUBLICATIONS

TW-201534785-A, English machine translation, Sep. 16, 2015.*

(Continued)

*Primary Examiner* — Michael H. Wilson
*Assistant Examiner* — Michael T Fulton
(74) *Attorney, Agent, or Firm* — Birch, Stewart, Kolasch & Birch, LLP

(57) ABSTRACT

A non-combustible heating-type smoking article includes: a tobacco part. The tobacco part includes: a tobacco filler; and a wrapper enclosing the tobacco filler. The tobacco part has a hardness of 0.41 to 1.5 N when compressed by a length corresponding to 10% of a diameter of the tobacco part in a diameter direction of the tobacco part. The wrapper is formed by attaching two or more sheets. The wrapper has a tensile strength of 10 to 30 N in a transverse direction crossing an axial direction of the tobacco part.

16 Claims, 12 Drawing Sheets

(56) References Cited

U.S. PATENT DOCUMENTS

| | | | | |
|---|---|---|---|---|
| 2015/0114405 | A1 | 4/2015 | Rasouli et al. | |
| 2016/0302478 | A1* | 10/2016 | Lavanant | A24D 3/061 |
| 2016/0331031 | A1 | 11/2016 | Malgat et al. | |
| 2017/0055576 | A1 | 3/2017 | Beeson et al. | |
| 2018/0125114 | A1 | 5/2018 | Zitturi et al. | |
| 2019/0000133 | A1 | 1/2019 | Park et al. | |
| 2019/0343174 | A1 | 11/2019 | Wang | |

FOREIGN PATENT DOCUMENTS

| | | | | | |
|---|---|---|---|---|---|
| CN | 1093556 | A | | 10/1994 | |
| CN | 107666835 | A | | 2/2018 | |
| CN | 108135289 | A | | 6/2018 | |
| EP | 3 199 702 | A1 | | 8/2017 | |
| EP | 3 556 937 | A1 | | 10/2019 | |
| JP | 2016-538863 | A | | 12/2016 | |
| JP | 2018-516565 | A | | 6/2018 | |
| KR | 10-0294308 | B1 | | 9/2001 | |
| KR | 10-2005-0056258 | A | | 6/2005 | |
| KR | 10-2006-0039455 | A | | 5/2006 | |
| KR | 10-2015-0009960 | A | | 1/2015 | |
| KR | 10-2017-0063816 | A | | 6/2017 | |
| KR | 10-2017-0123689 | A | | 11/2017 | |
| KR | 20180070517 | A | * | 6/2018 | |
| KR | 10-2018-0088770 | A | | 8/2018 | |
| KR | 10-2018-0111460 | A | | 10/2018 | |
| TW | 201534785 | A | * | 9/2015 | A24D 1/02 |
| WO | WO 2010/047389 | A1 | | 4/2010 | |
| WO | WO-2011000942 | A1 | * | 1/2011 | D21H 21/22 |
| WO | WO-2015082653 | A1 | * | 6/2015 | A24C 5/00 |
| WO | WO-2016156219 | A1 | * | 10/2016 | A24B 15/32 |
| WO | WO-2017036951 | A1 | * | 3/2017 | A24C 5/01 |
| WO | WO 2018/110059 | A1 | | 6/2018 | |

OTHER PUBLICATIONS

BR-0307705-A, English Machine translation, Jan. 11, 2005.*

KR-20180070517-A, English machine translation, Jun. 26, 2018.*

International Search Report (PCT/ISA/210) issued in PCT/JP2018/045101 mailed on Mar. 5, 2019.

Korean Office Action for Korean Application No. 10-2021-7015958, dated Jul. 6, 2023, with an English translation.

"China Compulsory National Standards Compilation Food," China Standard Publishing House, vol. 2, 2nd Edition, 1997, 5 pages total, with an English translation.

Chinese Office Action and Search Report for Chinese Application No. 201880099999.6, dated Nov. 18, 2022; with an English translation.

International Preliminary Report on Patentability and Written Opinion of the International Searching Authority, with an English translation, dated Jun. 17, 2021, for International Application No. PCT/JP2016/045101.

European Third Party Observation for European Application No. 24161373.6, dated Oct. 10, 2024.

Extended European Search Report for European Application No. 24161373.6, dated Jun. 21, 2024.

* cited by examiner

| | Classification | | | Example 1 | Example 2 | Example 3 |
|---|---|---|---|---|---|---|
| Measurement result of roll physical properties | Circumference | | mm | 22.00 | 22.00 | 22.00 |
| | Roll length | | mm | 56.0 | 56.0 | 56.0 |
| | Density | | g/cc | 0.41 | 0.37 | 0.37 |
| | Cigarette hardness | | % | 86.4 | 85.1 | 85.1 |
| | Winding hardness 1 measurement result 10% | | N | 1.34 | 0.94 | 1.07 |
| | Basis weight | | $g/m^2$ | 38 | 60 | 45.8 |
| | Thickness | | μm | 38 | 70 | 68 |
| | Air permeability | | C.U | 0 | 0 | 3 |
| | Whiteness | | % | 78 | 93 | 80 |
| | Opacity | | % | 93 | 87 | 66 |
| | 400°C Ash $CaCO_3$ | | % | 42 *Note 2 | 27 *Note 2 | 0 |
| Measurement result of cigarette paper physical properties | Cigarette paper features *Note 1 | | | Paper+Aluminum | Paper+Aluminum+Paper | Paper+Paper |
| | Longitudinal direction (MD) | Tensile strength | N | 25.7 | 25.7 | 45.8 |
| | | Stretching | % | 1.4 | 0.6 | 6.8 |
| | | Clark stiffness | $cm^3/100$ | 27.0 | 43.8 | 38.9 |
| | Transverse direction (CD) | Tensile strength | N | 20.2 | 25.7 | 34.9 |
| | | Elongation | % | 2.8 | 3.2 | 4.2 |
| | | Clark stiffness | $cm^3/100$ | 21.0 | 28.2 | 20.5 |
| | | 18 mm-method tensile strength | N | 14.4 | 14.5 | 24.9 |
| | | 18 mm-method elongation | % | 4.4 | 6.0 | 6.9 |
| | | 1% stress | N | 5.5 | 7.0 | 8.4 |
| Determination *Note 3 | | Presence or absence of circumferential increase | ×: Increase ○: No increase | ○ | ○ | ○ |

*Note 1: Paper and aluminum herein are as follows.
Paper: Pure white roll paper having a basis weight of $20g/m^2$
Aluminum: Aluminum foil having a thickness of 6 μm

*Note 2: Numerical values include the weight of residue derived from aluminum foil.

*Note 3: Determination (on whether or not the circumference has increased) was expressed as (x) when the amount of change in circumference after storage for 35 days exceeded 0.15 mm and (○) when it was 0.15 mm or less.

FIG. 7

| | Classification | | | Comparative example 1 | Comparative example 2 | Comparative example 3 | Comparative example 4 | Comparative example 5 | Comparative example 6 | Comparative example 7 |
|---|---|---|---|---|---|---|---|---|---|---|
| Measurement result of roll physical properties | Circumference | | mm | 24.50 | 22.00 | 22.00 | 22.00 | 22.00 | – | 22.00 |
| | Roll length | | mm | 57.0 | 57.0 | 56.0 | 56.0 | 56.0 | – | 56.0 |
| | Density | | g/cc | 0.21 | 0.21 | 0.37 | 0.37 | 0.36 | – | 0.37 |
| | Cigarette hardness | | % | 74.0 | 72.0 | 77.9 | 79.7 | 77.7 | – | 81 |
| | Winding hardness 1 measurement result 10% | | N | 0.40 | 0.39 | 0.85 | 0.67 | 0.61 | – | 0.83 |
| | Basis weight | | $g/m^2$ | 26 | 26 | 26 | 35 | 14 | 15.7 | 35.1 |
| | Thickness | | μm | 43 | 43 | 43 | 53 | 40 | 5.7 | 51 |
| | Air permeability | | C.U | 35 | 35 | 35 | 15 | 30000 | 0 | 60 |
| | Whiteness | | % | 89 | 89 | 89 | 94 | 80 | 23 | 81 |
| | Opacity | | % | 76 | 76 | 76 | 83 | 34 | 100 | 56 |
| | 400°C Ash $CaCO_3$ | | % | 30 | 30 | 30 | 35 | 0 | 100 *Note 2 | 0 |
| Measurement result of cigarette paper physical properties | Cigarette paper features *Note 1 | | | Typical | Typical | Typical | Cigarette paper with high basis weight | Cigarette paper with high air permeability | Aluminum 6 μm | Pure white roll paper |
| | Longitudinal direction (MD) | Tensile strength | N | 14.3 | 14.3 | 14.3 | 21.4 | 13.6 | 5.7 | 48.4 |
| | | Elongation | % | 1.0 | 1.0 | 1.0 | 1.1 | 1.6 | 1.7 | 2.2 |
| | | Clark stiffness | $cm^3/100$ | 10.2 | 10.2 | 10.2 | 22.8 | 7.0 | 2.9 | 19.5 |
| | Transverse direction (CD) | Tensile strength | N | 7.2 | 7.2 | 7.2 | 8.0 | 7.0 | 5.4 | 24 |
| | | Elongation | % | 6.0 | 6.0 | 6.0 | 4.4 | 4.0 | 1.9 | 3 |
| | | Clark stiffness | $cm^3/100$ | 4.6 | 4.6 | 4.6 | 6.6 | 2.0 | 3.6 | 10.1 |
| | | 18 mm-method tensile strength | N | 5.7 | 5.7 | 5.7 | 6.6 | 4.8 | 3.9 | 17.6 |
| | | 18 mm-method elongation | % | 10.9 | 10.9 | 10.9 | 6.2 | 4.9 | 2.7 | 5.6 |
| | | 1% stress | N | 1.4 | 1.4 | 1.4 | 4.0 | 2.0 | 2.7 | 7.0 |
| Determination | | Presence or absence of circumferential increase | ×: Increase ○: No increase | ○ | ○ | × | × | × | – | ○ |

*Note 1: Common: cigarette paper for traditional cigarettes
*Note 2: Numerical values are in wt% of the residue derived from aluminum foil

FIG. 8

| Classification | Elapsed days/Amount of change from original circumference of tobacco part (mm) | | | | | |
|---|---|---|---|---|---|---|
| | 0 | 5 | 18 | 35 | 63 | 96 |
| Example 1 | 0 | 0.04 | 0.04 | 0.03 | 0.04 | 0.03 |
| Example 2 | 0 | 0.04 | 0.03 | 0.04 | 0.06 | 0.03 |
| Example 3 | 0 | 0.04 | 0.04 | 0.04 | 0.05 | 0.05 |
| Comparative example 1 | 0 | 0.04 | 0.03 | 0.04 | 0.03 | 0.03 |
| Comparative example 2 | 0 | 0.04 | 0.03 | 0.04 | 0.03 | 0.03 |
| Comparative example 3 | 0 | 0.15 | 0.23 | 0.24 | 0.26 | 0.27 |
| Comparative example 4 | 0 | 0.13 | 0.23 | 0.25 | 0.26 | 0.27 |
| Comparative example 5 | 0 | 0.14 | 0.17 | 0.18 | 0.19 | 0.19 |
| Comparative example 6 | – | – | – | – | – | – |
| Comparative example 7 | 0 | 0.04 | 0.04 | 0.04 | 0.04 | 0.05 |

| Classification | State | Cigarette paper classification *Note 1 | Tensile strength *Note 2 | Elongation *Note 2 | 1% Stress *Note 2 |
|---|---|---|---|---|---|
| | | | N | % | N |
| Comparative example 1* | Cigarette | Common | 2.7 | 8.3 | 0.74 |
| Comparative example 4* | | Cigarette paper with high basis weight | 2.3 | 6.1 | 0.52 |
| Example 1* | | Paper 20 + AL | 14.5 | 4.7 | 6.58 |
| Comparative example 1 | Before rolling | Common | 5.7 | 10.9 | 1.4 |
| Comparative example 4 | | Cigarette paper with high basis weight | 6.6 | 6.2 | 4.0 |
| Example 1 | | Paper 20 + AL | 14.4 | 4.4 | 5.5 |

*Note 1: Common: cigarette paper for traditional cigarettes
AL: aluminum foil with a thickness of 6 μm
Paper 20: pure white roll paper with a basis weight of $20g/m^2$

*Note 2: The measurement method is the 18 mm method.

F I G. 13

NON-COMBUSTIBLE HEATING-TYPE SMOKING ARTICLE AND ELECTRIC HEATING-TYPE SMOKING SYSTEM

CROSS REFERENCES TO RELATED APPLICATIONS

This application is a Continuation Application of PCT Application No. PCT/JP2018/045101, filed on Dec. 7, 2018, the entire contents of which are incorporated herein by reference.

FIELD

The present invention relates generally to a non-combustible heating-type smoking article free from combustion and an electric heating-type smoking system.

BACKGROUND

Electrically heated smoking articles have been disclosed. When these smoking articles are used, a rod containing a tobacco filling is inserted into an insertion part of a main body. At the time of use, the rod is heated without combustion, thereby an aerosol is formed as mainstream smoke.

SUMMARY

According to one aspect of the present invention, a non-combustible heating-type smoking article includes: a tobacco part. The tobacco part includes: a tobacco filler; and a wrapper enclosing the tobacco filler. The tobacco part has a hardness of 0.41 to 1.5 N when compressed by a length corresponding to 10% of a diameter of the tobacco part in a diameter direction of the tobacco part. The wrapper is formed by attaching two or more sheets. The wrapper has a tensile strength of 10 to 30 N in a transverse direction crossing an axial direction of the tobacco part.

BRIEF DESCRIPTION OF THE DRAWINGS

FIG. 7 is a table showing product specifications and various test results for Examples 1 to 3.

FIG. 8 is a table showing product specifications and various test results for Comparative Examples 1 to 7.

FIG. 13 is a table showing tensile strength, elongation, and 1% stress in a transverse direction according to an 18 mm method for Example 1, Comparative Example 1, and Comparative Example 4 before rolling, as well as tensile strength, elongation, and 1% stress in a transverse direction according to an 18 mm method for Example 1*, Comparative Example 1*, and Comparative Example 4* as cigarettes.

DETAILED DESCRIPTION

Hereinafter, an embodiment of an electric heating-type smoking system will be described with reference to FIG. 1 to FIG. 6. The drawings schematically show each component of the invention. Thus, the dimensions of the drawings may not always match the dimensions of actual products.

Figure 1:
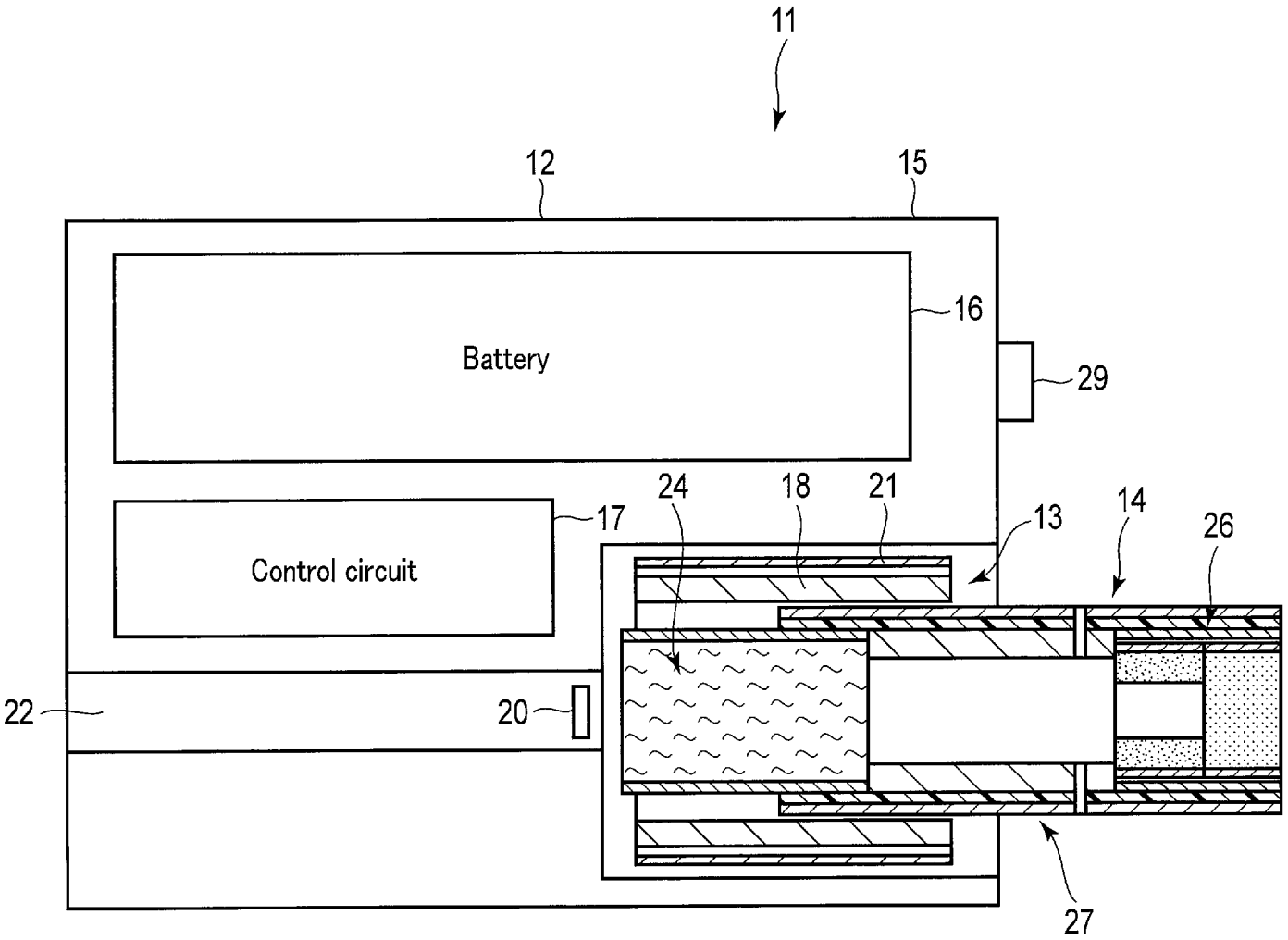
FIG. 1 is a cross-sectional schematic diagram showing an electric heating-type smoking system according to an embodiment.

As shown in FIG. 1, unlike in traditional cigarettes (cigarettes), an electric heating-type smoking system 11 is of a heating type that heats a tobacco filler through heating without combustion, and thereby the smoke aroma of tobacco can be tasted.

The electric heating-type smoking system 11 includes a main body 12 and a rod 14 (a non-combustible heating-type smoking article) that is configured to be attached to and detached from an insertion part 13 of the main body 12.

The main body 12 includes a box-shaped housing 15 and the insertion part 13 recessed into a cylindrical shape along the shape of the rod 14. The main body 12 include a battery 16, a control circuit 17, a pressure sensing part 20, a heat transfer part 18 (a heat exchanger tube), and a heater 21 provided around the heat transfer part 18, inside the housing 15. The housing 15 has a ventilation hole 22 and a switch 29 for activating the main body 12. The ventilation hole 22 communicates the outside of the housing 15 with the insertion part 13 and allows air to be supplied to the rod 14 inserted into the insertion part 13.

The control circuit 17 upon being supplied with power from the battery 16 energizes the heater 21 to adjust the temperature of the heater 21 within an appropriate range (100 to 400° C.). The pressure sensing part 20 includes a pressure sensor and is supplied with power from the control circuit 17. The pressure sensing part 20 senses a negative pressure inside the housing 15, thereby detecting that the user has inhaled.

The insertion part 13 is formed by recessing another portion of the housing 15 into a cylindrical shape. The insertion part 13 is provided with the heat transfer unit 18.

When the rod 14 is inserted into the insertion part 13, the heat transfer unit 18 and the heater 21 are disposed around the rod 14.

The heat transfer unit 18 has a hollow cylindrical shape and is provided inside the heater 21. The heat transfer unit 18 is made of a metal material. The metal material forming the heat transfer unit 18 is preferably a metal having a high thermal conductivity, such as gold, silver, copper, aluminum, or an alloy using any of these metals.

The heater 21 is formed of, for example, a common heating wire such as a nichrome wire. The heater 21 is wound around the heat transfer unit 18 and disposed in a cylindrical shape. Note that the heating manner of the heater 21 is not limited to a manner using Joule heat due to electric resistance, and may be, for example, an induction heating (IH) manner or a manner using a chemical reaction such as oxidation heat. The heater 21 is capable of heating the rod 14 (non-combustible heating-type smoking article). In this case, the material and shape of the heat transfer unit 18 may be suitably selected according to the heating manner. Note that the heater 21 heats the rod 14 (non-combustible heating smoking article) from the outside. The heater may be formed in the shape of a blade that can be inserted into the rod 14 (tobacco part 24) to heat the rod 14 from the inside.

Figure 2:
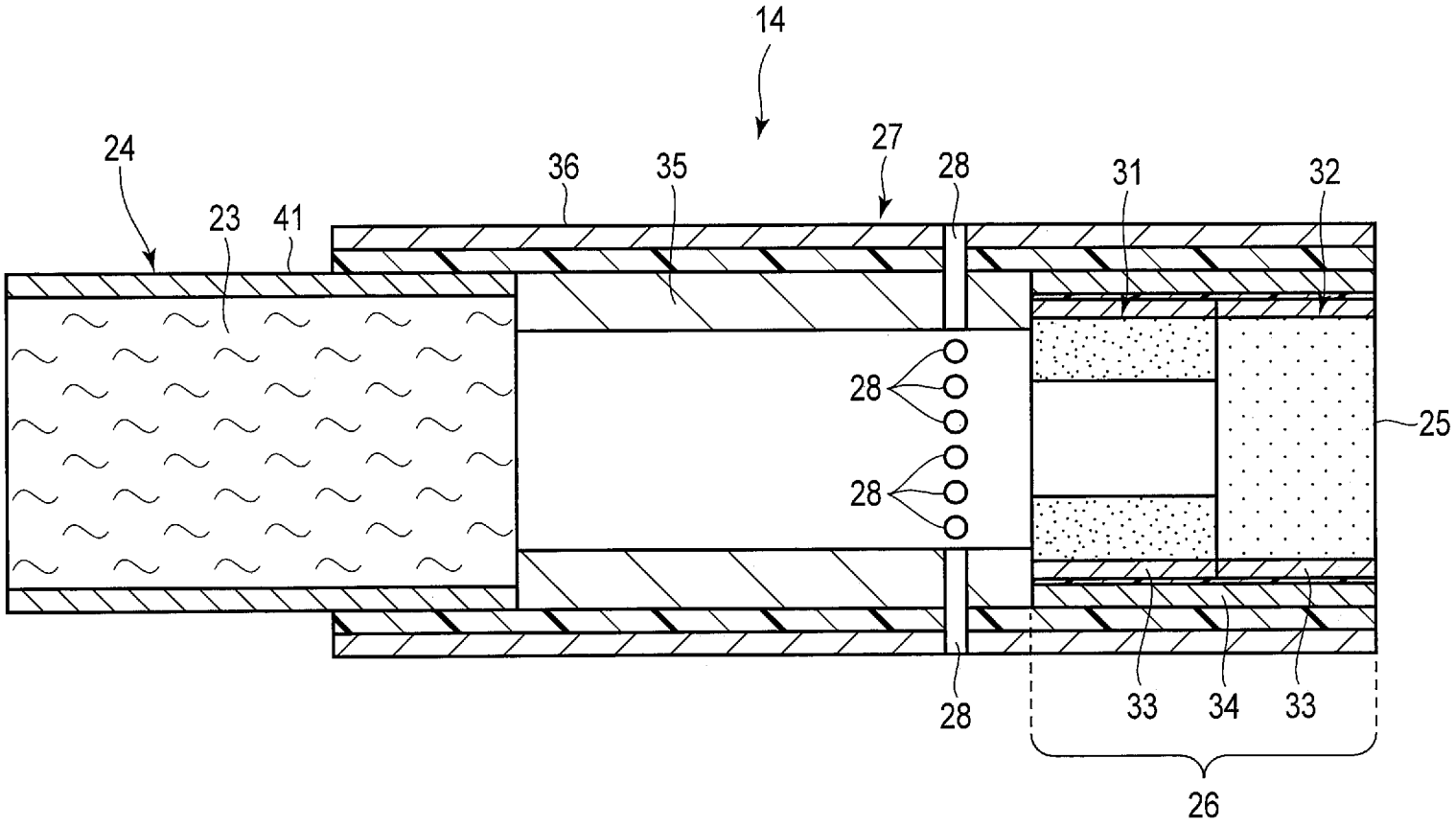
FIG. 2 is a cross-sectional schematic diagram showing an enlarged rod of the electric heating-type smoking system shown in FIG. 1.

As shown in FIG. 2, the rod 14 (non-combustible heating-type smoking article) is formed in a cylindrical shape. A circumference of the cylindrical rod 14 is preferably 16 mm to 27 mm, more preferably 20 mm to 26 mm, and even more preferably 21 mm to 25 mm. A full length (length in a horizontal direction) of the rod 14 is not particularly limited but is preferably 40 mm to 90 mm, more preferably 50 mm to 75 mm, and even more preferably 50 mm to 60 mm.

The rod 14 includes a tobacco part 24 filled with the tobacco filler 23, a filter part 26 including a suction port 25, a tubular connecting part 27 connecting the tobacco part 24 and the filter part 26, and an air vent part 28 provided in the connecting part 27. The air vent part 28 has two or more through holes so as to penetrate the connecting part 27 in the thickness direction. The two or more through holes are formed so as to be arranged radially as viewed from an extension of the central axis of the rod 14. In the present embodiment, the air vent part 28 is provided in the connecting part 27, but may be provided in the filter part 26. Further, in the present embodiment, the two or more through holes of the air vent part 28 are provided side by side in a row at regular intervals on one ring, but may be provided side by side in two rows at regular intervals on two rings; alternatively, the air vent part 28 with the one or two rows may be provided in a discontinuous or irregular manner. When the user holds the suction port 25 to inhale, outside air is taken into the mainstream smoke through the air vent part 28.

The filter part 26 is capable of filtering the aerosol generated from the tobacco filler 23. The filter part 26 takes a cylindrical shape. The filter part 26 includes a rod-shaped first segment 31 filled with acetyl cellulose acetate fibers and a rod-shaped second segment 32 likewise filled with acetyl cellulose acetate fibers. The first segment 31 is located on a side of the tobacco part 24. The first segment 31 may include a hollow part. The second segment 32 is located on a side of the suction port 25. The second segment 32 is solid. Each of the first segment 31 and the second segment 32 is wrapped with an inner plug wrapper 33. The first segment 31 and the second segment 32 are connected by an outer plug wrapper 34. The outer plug wrapper 34 is bonded to the first segment 31 and the second segment 32 by a vinyl acetate-based emulsion adhesive or the like.

The length of the filter part 26 can be, for example, 10 to 30 mm, the length of the connecting part 27 can be, for example, 10 to 30 mm, the length of the first segment 31 can be, for example, 5 to 15 mm, and the length of the second segment 32 can be, for example, 5 to 15 mm. The lengths of these individual segments are one example, and can be appropriately changed according to production suitability, required quality, the length of the tobacco part 24, or the like.

For example, the first segment 31 (center hole segment) includes a first filling layer having one or more hollow parts and the inner plug wrapper 33 covering the first filling layer. The first segment 31 has a function of increasing the strength of the second segment 32. The first filling layer of the first segment 31 is filled with, for example, cellulose acetate fibers at a high density. The cellulose acetate fibers are cured through addition of a triacetin-containing plasticizer in an amount of, for example, 6 to 20% by mass with respect to the mass of the cellulose acetate. The hollow part of the first segment 31 has an inner diameter of, for example, φ1.0 to φ5.0 mm.

The first filling layer of the first segment 31 has a higher filling density of fibers than the second filling layer of the second segment 32. Therefore, at the time of inhalation, air or aerosol flows only through the hollow part, and almost no air or aerosol flows through the first filling layer. For example, when it is desired to diminish the decrease in aerosol component due to filtration in the second segment 32, for example, the length of the second segment 32 may be shortened to make the first segment 31 longer accordingly.

Replacing the shortened second segment 32 with the first segment 31 is effective in increasing the delivery of aerosol components. Since the first filling layer of the first segment 31 is a fiber filling layer, the feeling of touch from the outside during use does not cause discomfort to the user.

The second segment 32 includes of a second filling layer and the inner plug wrapper 33 covering the second filling layer. The second segment 32 (filter segment) is filled with cellulose acetate fibers at a typical density and has performance of filtering typical aerosol components.

The filtration performance for filtering aerosol (mainstream smoke) emitted from the tobacco part 24 may be different between the first segment 31 and the second segment 32. At least one of the first segment 31 and the second segment 32 may contain flavor. The filter part 26 may take any structure, and may have a structure in which multiple segments are provided as described above or may be formed of a single segment.

The connecting part 27 has a cylindrical shape. The connecting part 27 includes a paper tube 35 obtained by, for example, forming thick paper into a cylindrical shape, and a lining paper 36 enclosing the paper tube 35. One surface (inner surface) of the lining paper 36 is coated with a vinyl acetate-based emulsion adhesive on the entire or almost the entire surface except the vicinity of the air vent part 28. The lining paper 36 is wound in a cylindrical shape around the outside of the tobacco part 24, the paper tube 35, and the filter part 26 to connect them integrally. A plurality of air vent parts 28 are formed by laser processing from the outside after the tobacco part 24, the paper tube 35, and the filter part 26 are integrated by the lining paper 36.

The tobacco part 24 has a cylindrical shape. A full length (a length in the axial direction) of the tobacco part 24 is preferably, for example, 20 to 70 mm, more preferably 20 to 50 mm, and even more preferably 20 to 30 mm. A cross sectional shape of the tobacco part 24 is not particularly limited, and may be for example, a circle, an ellipse, a polygon, or the like.

The tobacco part 24 includes the tobacco filler 23 and a wrapper 41 enclosing the tobacco filler 23. The wrapper 41 wraps around the tobacco filler 23. The tobacco filler 23 is formed of a cut rag of leaf tobacco (dried leaf) and/or a sheet-molded material that is cut to a predetermined width of a sheet into which pulverized leaf tobacco is molded. The tobacco filler 23 is formed by being filled with a cut piece (sheet-shaped molded material) having a predetermined width from a sheet into which pulverized leaf tobacco is molded and/or a cut rag of a leaf tobacco (dried leaf) in a random orientation. This sheet-molded material may contain an aerosol-generating base material and a second flavor component. The aerosol-generating base material and the second flavor component may be added to or contained in the cut rag of leaf tobacco. Examples of the aerosol-generating base material include glycerin, propylene glycol (PG), triethylcitrate (TEC), triacetin, and 1,3-butanediol. These may be used alone or in combination of two or more.

The tobacco filler (tobacco filling material) 23 according to the present invention includes tobacco and an aerosol-forming substrate. The tobacco filler 23 may further include a second flavor component, water, or the like. There are no particular restrictions on the size of tobacco used as tobacco filler 23 or the method for preparing it. As the tobacco filler 23, for example, dried tobacco leaf cut into strips having a width of 0.8 to 1.2 mm may be used. When cut into the above width, resultant cut rags of the tobacco leaf will have a length of approximately 1 to 40 mm. Alternatively, the dried tobacco leaf may be pulverized and homogenized to have an average particle size of about 20 to 200 μm, processed into a sheet, and then cut into strips (sheet-molded material) having a width of 0.8 to 1.2 mm to use as the tobacco filler 23. When cut into the above width, the cut rags will have a length of approximately 1 to 40 mm. Further, the above sheet-processed material that is gathered instead of being cut may be included as the tobacco filler 23. Various kinds of tobacco can be used for the tobacco included in the tobacco filler 23 regardless of whether the dried tobacco leaf is cut for use or used as a pulverized and homogenized sheet. For the tobacco filler 23, flue-cured tobacco, burley tobacco, oriental tobacco, domestic tobacco, or other varieties such as *Nicotiana tabacum* L., *Nicotiana rustica L., and Nicotiana tomentosa* may be blended as appropriate to realize an intended taste to use. Details of the tobacco varieties are disclosed in "Encyclopedia of Tobacco, Tobacco Academic Studies Center, 2009 Mar. 31". There are conventional methods for pulverizing tobacco to process it into a homogenized sheet. The first is a filtered-out sheet made by a papermaking process; the second is a cast sheet made by mixing a suitable solvent such as water and a required kind/amount of a binder with a pulverized tobacco material, homogenizing the mixture, and then thinly casting the homogenized mixture on a plate or plate belt made of metal, and drying the cast mixture; and the third is a rolled sheet made by mixing a suitable solvent such as water and a required kind/amount of a binder with a pulverized tobacco material, homogenizing the mixture, and extruding the homogenized mixture into a sheet shape. Details of the kinds of the uniform sheet are disclosed in "Encyclopedia of Tobacco, Tobacco Academic Studies Center, 2009 Mar. 31".

It is preferable that for the tobacco filler 23, the aerosol-generating base material and the second flavor be applied to or contained in the leaf tobacco (dried leaf) and the sheet into which pulverized leaf tobacco is molded. The aerosol-generating base material is preferably contained in an amount of 10 to 30% by weight with respect to the leaf tobacco (dried leaf) and the sheet into which the pulverized leaf tobacco is molded. The aerosol-generating base material is a material capable of generating an aerosol through heating; and examples thereof include glycerin, propylene glycol (PG), triethylcitrate (TEC), triacetin, and 1,3-butanediol. These may be used alone or in combination of two or more.

The second flavor component contained in the tobacco filler 23 is not limited and can be any type of flavor provided that it is a flavor used for the electric heating-type smoking system 11. The second flavor component used can be one selected from the group consisting of: menthol; natural plant flavors (e.g., cinnamon, sage, herb, chamomile, kudzu (*Pueraria lobata*), hydrangeae dulcis folium, clove, lavender, cardamom, caryophyllus, nutmeg, bergamot, geranium, honey essence, rose oil, lemon, orange, cassia bark, caraway, jasmine, ginger, coriander, vanilla extract, spearmint, peppermint, cassia, coffee, celery, cascarilla, sandalwood, cocoa, ylang ylang, fennel, anise, licorice, St John's bread, prune extract, and peach extract); saccharides (e.g., glucose, fructose, isomerized saccharide, and caramel); cocoa (e.g., powder and extract); esters (e.g., isoamyl acetate, linalyl acetate, isoamyl propionate, and linalyl butyrate); ketones (e.g., menthone, ionone, damascenone, and ethyl maltol); alcohols (e.g., geraniol, linalool, anethole, and eugenol); aldehydes (e.g., vanillin, benzaldehyde, and anisaldehyde); lactones (e.g., y-undecalactone and y-nonalactone); animal flavors (e.g., musk, ambergris, civet, and castoreum); hydrocarbons (e.g., limonene and pinene); and extract of tobacco plant (tobacco leaf, tobacco stem, tobacco flower, tobacco root, and tobacco seed). Menthol is particularly preferred. Alternatively, as the second flavor component, two or more kinds selected from the above group may be mixed and used.

The second flavor component may be used as a solid, or may be used by being dissolved or dispersed in a suitable solvent such as propylene glycol, ethyl alcohol, benzyl alcohol, and triethyl citrate. A flavor which easily forms a dispersion state in a solvent by addition of an emulsifier, such as a hydrophobic flavor and oil-soluble flavor, may be preferably used. Such second flavor components may be used alone or in combination.

The filling density (roll density) of the tobacco filler 23 in the tobacco part 24 is, for example, 0.3 to 0.5 g/cc, preferably 0.35 to 0.45 g/cc, and more preferably 0.37 to 0.41 g/cc. To be specific, when the tobacco part 24 has a circumference of 22 mm and a length of 20 mm, the range of the content of the tobacco filler 23 in the tobacco part 24 can be from 225 to 380 mg, preferably from 265 to 340 mg, and more preferably from 280 to 310 mg, per tobacco part 24. The tobacco part 24 hardness (cigarette hardness, repulsive force of the tobacco part 24) when measured by a new method explained in Examples described later may be, for example, from 0.41 to 1.5 N, preferably from 0.8 to 1.4 N, and more preferably from 0.94 to 1.34 N. The length of the tobacco part 24 when measured by the new method is not particularly limited, but may be, for example, from 5 to 15 mm.

On the other hand, the hardness (cigarette hardness) of the tobacco part 24 measured by a conventional method explained in Examples described later may be, for example, from 80 to 95%, preferably from 85 to 90%, and more preferably from 85.1 to 86.4%. The measurement conditions for the conventional method are not limited to, for example, a load F applied to the tobacco part 24 being, for example, from 1 to 3 kg, and time t for the load to be applied being, for example, from 5 seconds to a few minutes.

Figure 3:
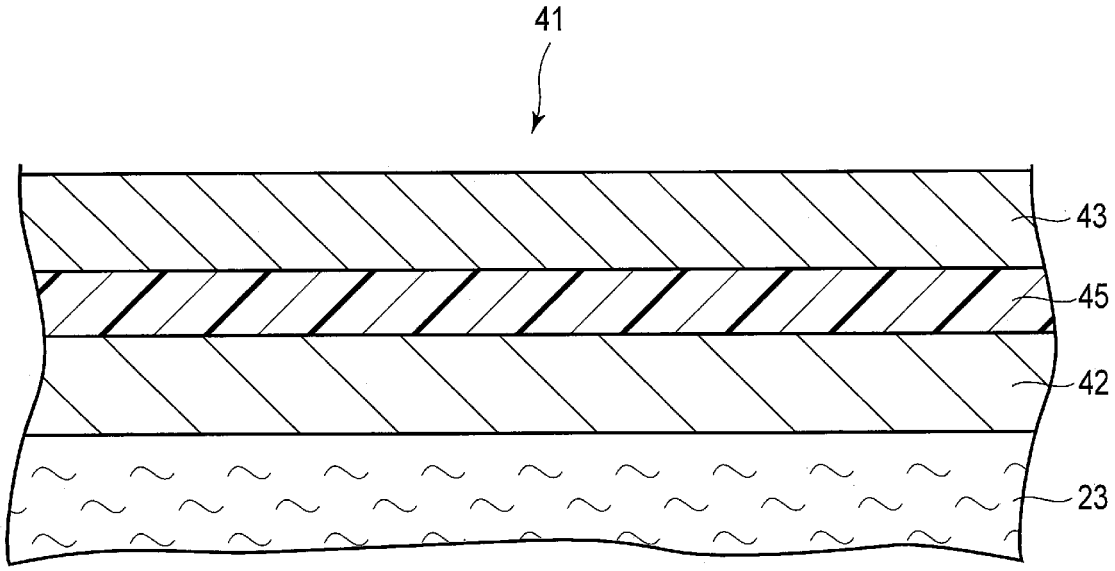
FIG. 3 is a cross-sectional view showing a wrapper and a tobacco filler of a tobacco part in a first modification in the rod shown in FIG. 2.

FIG. 3 shows the wrapper 41 in the first modification. The wrapper 41 may include a first sheet 42 made of metal, a second sheet 43 made of paper, and a bonding part 45 bonding the first sheet 42 and the second sheet 43. The second sheet 43 is bonded to a surface of the first sheet 42 opposite to the surface facing the tobacco filler 23. Accordingly, in the tobacco part 24, the first sheet 42 is positioned inside (on a side of the tobacco filler 23) and the second sheet 43 is positioned outside. Thus, the wrapper 41 has the appearance of paper when viewed from the outside.

Figure 4:
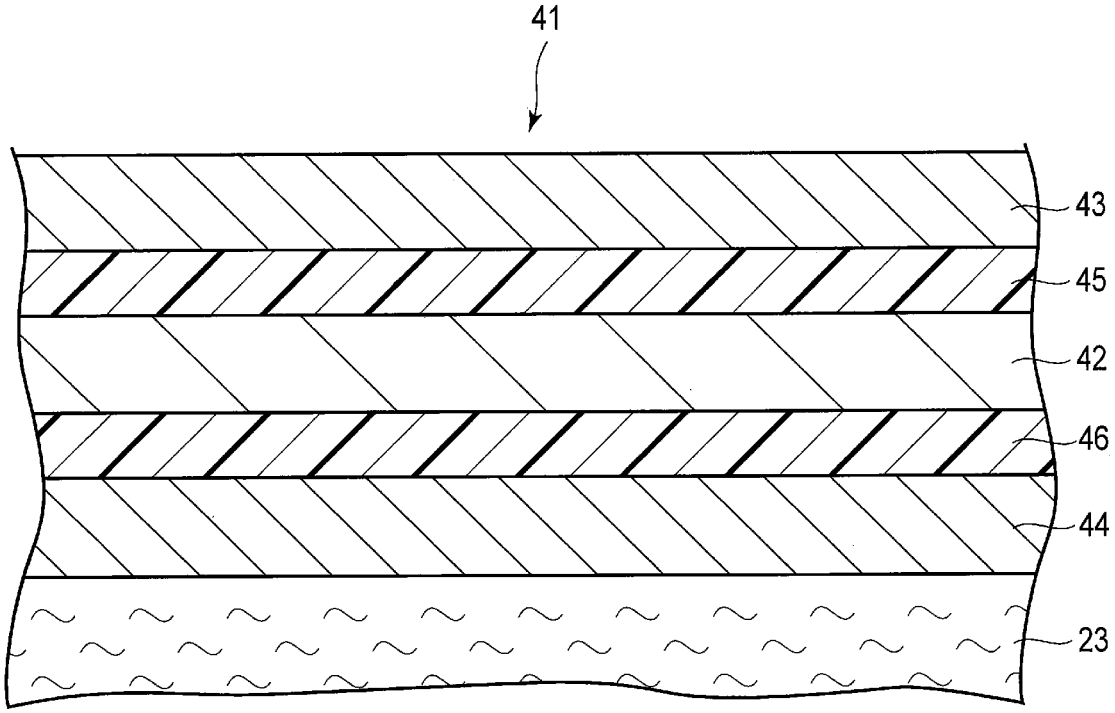
FIG. 4 is a cross-sectional view showing a wrapper and a tobacco filler of a tobacco part in a second modification in the rod shown in FIG. 2.

FIG. 4 shows the wrapper 41 in the second modification. The wrapper 41 may include the first sheet 42 made of metal, the second sheet 43 (outer sheet) made of paper, a third sheet 44 (inner sheet) made of paper, the bonding part (a first bonding part) 45 bonding the first sheet 42 and the second sheet 43, and a second bonding part 46 bonding the first sheet 42 and the third sheet 44. The second sheet 43 is bonded to a first surface (outside) of the first sheet 42. The third sheet 44 is bonded to a second surface (inside, on the tobacco filler 23 side) of the first sheet 42 opposite to the first surface. Accordingly, the wrapper 41 has the appearance of paper on both its front and back sides.

Figure 5:
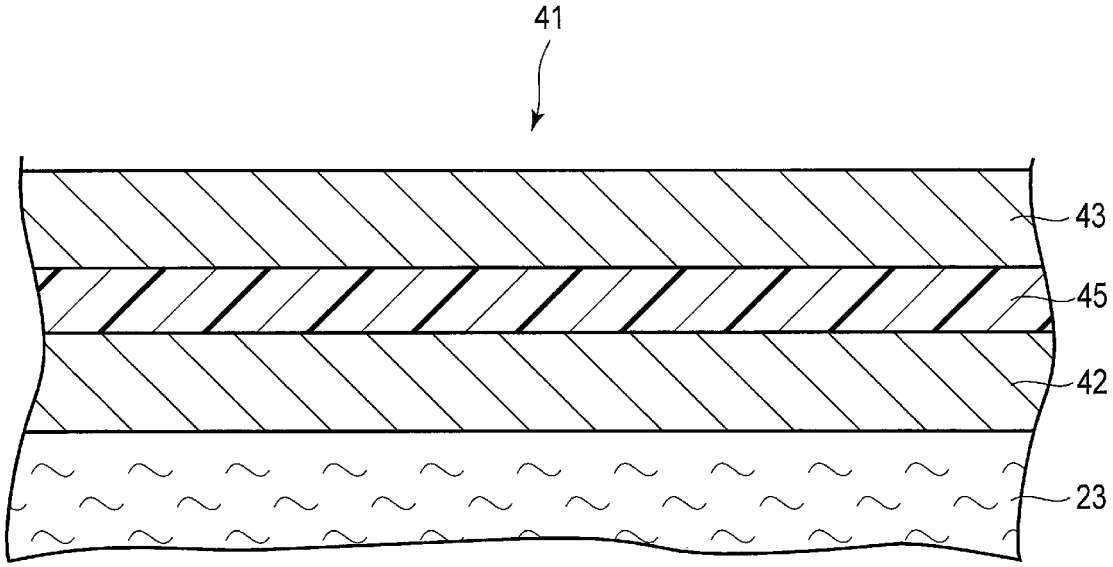
FIG. 5 is a cross-sectional view showing a wrapper and a tobacco filler of a tobacco part in a third modification in the rod shown in FIG. 2.

FIG. 5 shows the wrapper 41 in the third modification. The wrapper 41 may take the form shown in FIG. 5. The wrapper 41 may include the first sheet 42 made of paper, the second sheet 43 made of paper, and the bonding part 45 bonding the first sheet 42 and the second sheet 43. The second sheet 43 is bonded to a surface of the first sheet 42 opposite to the surface facing the tobacco filler 23. Accordingly, in the tobacco part 24, the first sheet 42 is positioned inside (on a side of the tobacco filler 23) and the second sheet 43 is positioned outside. In this form as well, the wrapper 41 has the appearance of paper on both its front and back sides.

In the tobacco part 24 of the rod 14 (non-combustible heating smoking article), the wrapper 41 in any one of the above three forms can be adopted.

When the first sheet 42 is made of metal as in the above first and second modifications, the material forming the metal foil of the first sheet 42 is preferably a metal foil which has good thermal conductivity and which is inexpensive and resistant to rust as well as has high workability; for example, one selected from the group consisting of aluminum, copper, gold, silver, and tin, or an alloy of any of these can be used. A thickness of the first sheet 42 is preferably from 6 to 18 μm, more preferably from 6 to 12 μm, and even more preferably from 6 to 8 μm. The lower limit of the thickness of the first sheet 42 is determined by, for example, the ease of handling when the first sheet 42 and the second sheet 43 are attached to each other. That is, if the thickness of the first sheet 42 is less than 6 μm, the strength would be insufficient, and the first sheet 42 when attached would be more likely to tear. The upper limit of the thickness of the first sheet 42 is determined by, for example, the appearance quality of the rod 14. That is, if the thickness of the first sheet 42 is greater than 18 μm, the wrapper 41 would have an increased rigidity (Clark stiffness), and the roundness of the rod 14 from rolling into a cylindrical shape would be more likely to decrease. The material forming the metal foil of the first sheet 42 is preferably aluminum from the viewpoint of fire resistance, corrosion resistance, workability, manufacturing cost, etc.

The bonding part 45 bonds the first sheet 42 to the second sheet 43 preferably over their entire surfaces. When the wrapper 41 in the second modification is adopted, the second bonding part 46 bonds the first sheet 42 to the second sheet 43 preferably over their entire surfaces. The bonding part 45 and the second bonding part 46 are preferably formed of, for example, a vinyl acetate-based emulsion-based adhesive. Alternatively, the bonding part 45 and the second bonding part 46 may be formed of, for example, starch glue.

When the first sheet 42 is formed of paper as in the wrapper 41 in the above third modification, the first sheet 42 has a basis weight of 10 to 30 g/m$^2$, preferably 15 to 25 g/m$^2$. The second sheet 43 has a basis weight of 10 to 30 g/m$^2$, preferably 15 to 25 g/m$^2$. The first sheet 42 and the second sheet 43 may have the same basis weight or the like, or may have different basis weights or the like.

The basis weight of the wrapper 41 as a whole may be, for example, 30 to 70 g/m$^2$, preferably 35 to 65 g/m$^2$, and more preferably 38 to 60 g/m$^2$. The thickness of the wrapper 41 as a whole may be 30 to 80 μm, preferably 35 to 75 μm, and more preferably 38 to 70 μm. Since the rod 14 (non-combustible heating-type smoking article) of the present embodiment does not involve combustion, the wrapper 41 requires almost no air permeability; and the air permeability of the wrapper 41 is, for example, from 0 to 3 CU.

A whiteness (ISO 2470) of the wrapper 41 may be, for example, 70 to 100%, preferably 75 to 95%, and more preferably 78 to 93%. An opacity (ISO 2471) of the wrapper 41 may be, for example, 60 to 100%, preferably 65 to 95%, and more preferably 66 to 93%.

A tensile strength of the wrapper 41 in the axial direction, i.e., the longitudinal direction, of the tobacco part 24 is, for example, 20 to 50 N, preferably 24 to 47 N, and more preferably 25.7 to 45.8 N when measured by the 180 mm method (JIS P 8113) explained in Examples described later. In this case, the longitudinal direction is the forward direction (the traveling direction of paper (fiber orientation) in a paper machine): a machine direction (MD)), and corresponds to the axial direction of the tobacco part. An elongation of the wrapper 41 in the longitudinal direction is, for example, 0.3 to 8%, preferably 0.5 to 7%, and more preferably 0.6 to 6.8% when measured by the 180 mm method (JIS P 8113). A Clark stiffness (JIS P 8143 2009, paper-rigidity test method-Clark rigidity tester method) of the wrapper 41 in the longitudinal direction (MD) is, for example, 25 to 45 cm$^3$/100, preferably 26 to 44 cm$^3$/100, and more preferably 27 to 43.8 cm$^3$/100.

A tensile strength of the wrapper 41 in the transverse direction, which is a direction crossing the axial direction of the tobacco part 24, is, for example, 18 to 37 N, preferably 19 to 36 N, and more preferably 20.2 to 34.9 N when measured by the 180 mm method (JIS P 8113). In this case, the transverse direction is a reverse direction (the width direction in a paper machine (a direction perpendicular to the traveling direction of paper): cross machine direction (CD)), and corresponds to a direction perpendicular to the axial direction of the tobacco part. An elongation (%) of the wrapper 41 in the transverse direction is, for example, 0.1 to 5%, preferably 0.8 to 4.5%, and more preferably 2.8 to 4.2% when measured by the 180 mm method (JIS P 8113). The Clark stiffness of the wrapper 41 in the transverse direction (CD) is, for example, 20 to 30 cm$^3$/100, and preferably 20.5 to 28.2 cm$^3$/100.

A tensile strength of the wrapper 41 in the transverse direction, which is a direction crossing the axial direction of the tobacco part (tobacco part 24), is, for example, 10 to 30 N, preferably 13 to 27 N, and more preferably 14.4 to 24.9 N when measured by the 18 mm method explained in Examples described later.

An elongation (%) of the wrapper 41 in the transverse direction, which is a direction crossing the axial direction of the tobacco part (tobacco part 24), is, for example, 0.1 to 8%, preferably 4 to 7%, and more preferably 4.4 to 6.9% when measured by the 18 mm method.

A 1% stress, which is a stress when the wrapper 41 as measured by the 18 mm method is elongated by 1% (that is, when elongated by 0.18 mm) in the transverse direction, is, for example, 4 to 10 N, preferably 5 to 9 N, and more preferably 5.5 to 8.4 N.

Figure 6:
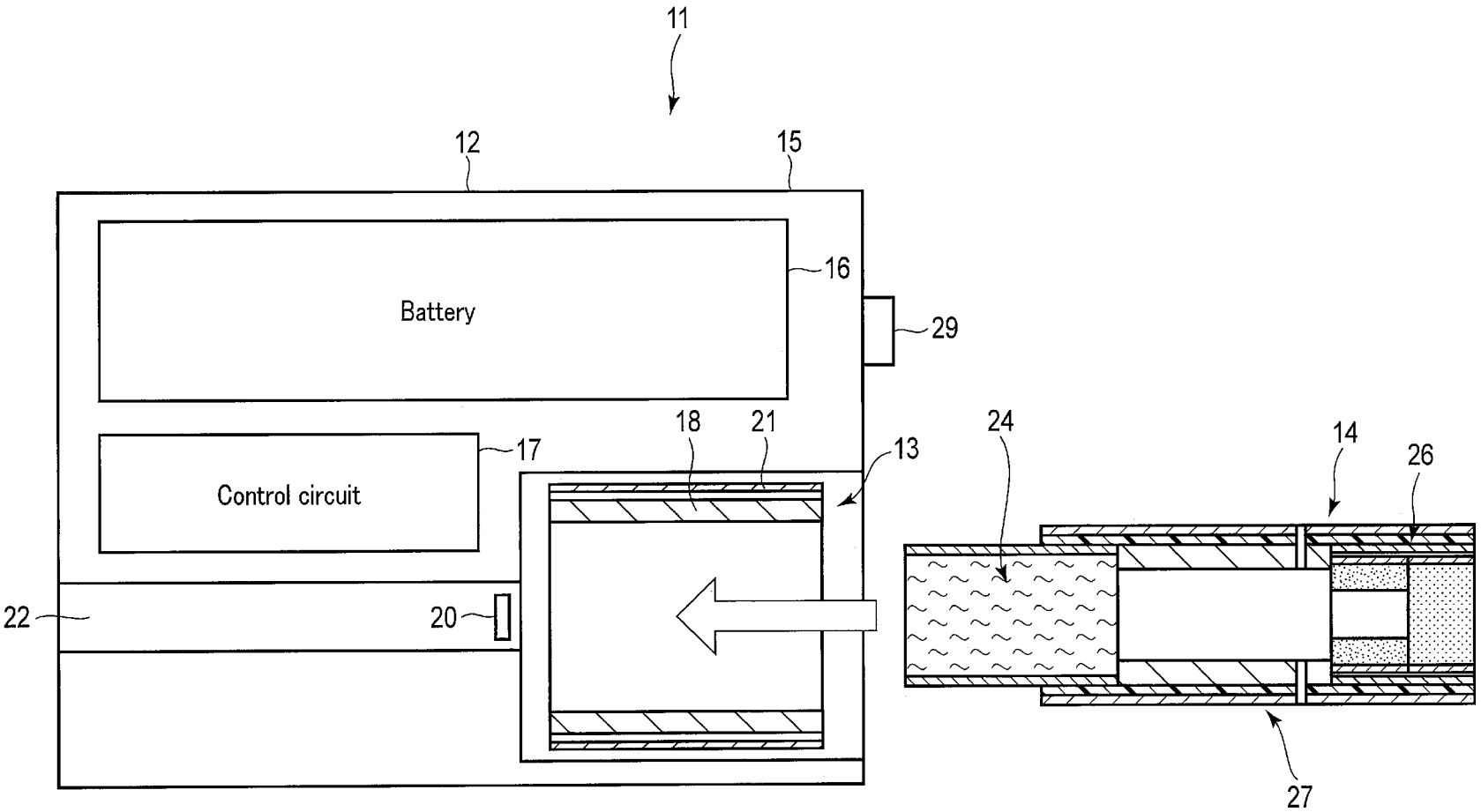
FIG. 6 is a cross-sectional schematic diagram illustrating a process of inserting a rod into a main body of an electric heating-type smoking system according to an embodiment.

Next, the operation of the electric heating-type smoking system 11 will be described. As shown in FIG. 6, by inserting the rod 14 into the insertion part 13 of the main body 12, the main body 12 is equipped with the rod 14. In this state, when the user pushes down a switch 29 to activate the main body 12, the control circuit 17 drives the heater 21 to raise the temperature of the heater 21 and the heat transfer unit 18 to a predetermined temperature (for example, 100 to 400° C.). Thereby, the tobacco part 24 is heated. In this state, when the user holds the suction port 25 and starts inhaling, vapor (aerosol) containing smoke aroma of tobacco is emitted from the tobacco part 24. The vapor is cooled by the air flowing into the inside of the connecting part 27 from the air vent part 28, thereby more reliable aerosolization (formation of minute droplets) is performed.

The aerosol is appropriately filtered by the filter part 26 and delivered to the user's oral cavity. This allows the user to taste the smoke aroma of tobacco. At this time, the control circuit 17 senses a negative pressure in the housing 15 through the pressure sensing part 20. The control circuit 17 thus can count the number of times the user has inhaled and calculate the total inhalation time. The control circuit 17 stops the heating of the heater 21 and the heat transfer part 18 when a predetermined time elapses after the switch 29 is pressed, the user performs a predetermined number of inhalations, the total inhalation time of the user exceeds a predetermined time, or the user presses the switch 29 again to release the active state. One smoking operation thus ends. Then, by removing the used rod 14 from the insertion part 13 and inserting a new rod 14 into the insertion part 13, the user can again taste the tobacco smoke aroma from the new rod 14.

A method for producing the electric heating-type smoking system 11 of the present embodiment will be described. Various methods can be used for producing the electric heating-type smoking system 11; however, an example producing method will be described below. First, in the wrapper production line, the second sheet 43 is bonded to the first sheet 42. When the wrapper is in the second modification, not only is the second sheet 43 bonded to the first sheet 42, but also the third sheet 44 is bonded to the first sheet 42. At that time, for example, a vinyl acetate-based emulsion adhesive intended to serve as the bonding part 45 is applied to one surface of the first sheet 42. When the wrapper is in the second modification, a vinyl acetate-based emulsion adhesive intended to serve as the second bonding part 46 is applied to, for example, one surface of the third sheet 44 in parallel with or before and/or after the bonding of the first sheet 42 to the second sheet 43.

Thereafter, the first sheet 42 and the second sheet 43 are passed between a pair of rollers, so that the second sheet 43 is bonded to the first sheet 42. When the wrapper is in the second modification, the first sheet 42, the second sheet 43, and the third sheet 44 are passed between a pair of rollers, so that the second sheet 43 and the third sheet 44 are bonded to the first sheet 42. The wrapper 41 in which these are integrated may be cut in a predetermined width by a cutter or the like as necessary. Note that this cutting process may be performed after the integrated wrapper 41 is rolled up into a roll shape. In addition, any method for bonding individual sheets can be taken; as a matter of course, an operator may manually attach the first sheet 42 and the second sheet 43, or the first sheet 42, the second sheet 43, and the third sheet 44, to each other without using a roll pair.

Thereafter, the wrapper 41 is introduced into a common cigarette making machine and wound around the tobacco filler 23. At this time, the wrapper 41 is set in the cigarette making machine such that the first sheet 42 is inside (on the tobacco filler 23 side). Thereby, the tobacco part 24 is formed. The tobacco part 24 is arranged in series with a paper tube 35 and the filter part 26 that are separately prepared. The tobacco part 24, the paper tube 35, and the filter part 26 in series are integrally rolled with a lining paper 36, whereby the rod 14 for the electric heating-type smoking system 11 is produced.

The main body 12 of the electric heating-type smoking system 11 can also be produced by a known producing method for an electronic device. By combining the rod 14 and the main body 12 thus produced, the electric heating-type smoking system 11 is realized.

Note that when the wrapper 41 is formed in the second modification, a first flavor component that is the same as or different from a second flavor component included in the tobacco filler 23 may be applied to the third sheet 44 inside the wrapper 41 subsequent to the bonding process. This first flavor component that is dissolved in ethyl alcohol or the like is applied to the third sheet 44 from a nozzle. After the ethyl alcohol or the like evaporates, the wrapper 41 is wound around a bobbin to finish the wrapper 41. The wrapper 41 is cut into a predetermined width as necessary. In the case where the first flavor component is applied to the third sheet 44, the wrapper 41 wound around the bobbin is packaged in a bag or the like, and sealed to store. The wrapper 41 is preferably sealed in a packaging container having a high gas barrier property, for example, a so-called vacuum pack in which nylon having a predetermined thickness and low-density polyethylene having a predetermined thickness are laminated. The wrapper 41 housed in the packaging container having the high gas barrier property is preferably stored in an environment with a temperature of 15 to 30° C. and a relative humidity of 50 to 90%. The wrapper 41 to which the first flavor component is added is introduced into a common cigarette making machine and wound around the tobacco filler 23 in a manner similar to the other wrapper 41. The process is the same as that described above.

According to the embodiment, the following can be said.

The non-combustible heating-type smoking article (rod 14) includes the tobacco part 24 provided with the tobacco filler 23 and the wrapper 41 enclosing the tobacco filler 23, wherein the tobacco part 24 has a hardness of 0.41 to 1.5 N when compressed by a length corresponding to 10% of the diameter of the tobacco part 24 in the diameter direction of the tobacco part 24, the wrapper 41 is formed by attaching two or more sheets, and the wrapper 41 has a tensile strength of 10 to 30 N in the transverse direction crossing the axial direction of the tobacco part 24 when measured by the 18 mm method.

According to this configuration, the wrapper 41 with the structure of being formed by attaching the two or more sheets has a tensile strength of 10 to 30 N when measured by the 18 mm method in the transverse direction, which makes it possible to manage the circumference of the tobacco part 24 appropriately in a non-combustible heating-type smoking article having a hard tobacco part 24. This prevents the circumference of the tobacco part 24 from increasing during storage, and prevents the non-combustible heating-type smoking article from being caught at the periphery of the insertion part 13 and becoming difficult to insert, or prevents part of the non-combustible heating-type smoking article from remaining in the insertion part 13 when the non-combustible heating-type smoking article is removed from the insertion part 13 after use.

Alternatively, if the tobacco part 24 is made too small in advance in consideration of the increase in the circumference of the tobacco part 24 during storage, and if the circumference of the tobacco part 24 has not increased as anticipated, a gap may be provided between the non-combustible heating-type smoking article inserted into the insertion part 13 of the electric heating-type smoking system 11 and the heater 21/heat transfer unit 18 of the electric heating-type smoking system 11. In such a case, the thermal conductivity would deteriorate, and heating as designed thus may not be performed. According to the non-combustible heating-type smoking article of the present embodiment, the circumference of the tobacco part 24 can be appropriately managed, and the non-combustible heating-type smoking article thus can be effectively brought into contact with or close to the heater 21, the heat transfer unit 18 or the like, and heating as designed can be performed to deliver a high-quality smoke aroma of tobacco to a user. If the tobacco part 24 can have the hardness increased, the tobacco part 24 will not be crushed or bent when the non-combustible heating-type smoking article is inserted into the insertion part 13, which can facilitate the insertion or prevent the tobacco filler 23 from being spilled, which may occur in removing the non-combustible heating-type smoking article. In addition, if the tobacco part 24 can have the hardness increased, the filling amount of the tobacco filler 23 can also be increased, and a sufficient amount of aerosol can thus be generated. This makes it possible to give a user a feeling of satisfaction with the aroma and taste of the electric heating-type smoking system 11.

In this case, the wrapper 41 includes the first sheet 42 made of metal and the second sheet 43 made of paper. According to this configuration, the tensile strength or the like of the wrapper 41 can be increased by the first sheet 42 made of metal, which makes it possible to provide a non-combustible heating-type smoking article in which the circumference of the tobacco part 24 can be managed more appropriately as compared to the conventional wrapper 41 formed of a single sheet of paper. Further, because of the inclusion of the first sheet 42 made of metal, blocking properties for the flavor component and the moisture are improved. Thus, the second flavor component and moisture contained in the tobacco filler 23 do not penetrate the wrapper 41 to form stains. This makes it possible to prevent a defect in the appearance of the non-combustible heating-type smoking article so as to provide the appearance quality as designed for a user. Further, even if a user erroneously ignites the tobacco part 24 as in a conventional cigarette, the tobacco part 24 can be prevented from being actually ignited, and an erroneous use mode can be prevented.

In this case, the first sheet 42 is positioned on the tobacco filler 23 side, and the second sheet 43 is positioned outside. This configuration allows the tobacco part 24 to have an appearance similar to that of a traditional cigarette, and a user will not have a feeling of discomfort.

In the case of the second modification, the wrapper 41 includes the third sheet 44 made of paper attached to a side of a second surface of the first sheet 42 opposite to a first surface to which the second sheet 43 is attached. This configuration can realize the wrapper 41 having further higher strength, which can provide a non-combustible heating-type smoking article in which the circumference can be yet more appropriately managed. In addition, the inner surface of the wrapper 41 can be made to have a paper appearance, which can more reliably prevent a user from feeling strange.

In the case of the third modification, the wrapper 41 includes the first sheet 42 made of paper and the second sheet 43 made of paper. According to this configuration, two sheets made of paper are attached to each other, which can also make the tensile strength sufficiently large, and a non-combustible heating-type smoking article in which the circumference of the tobacco part 24 can be appropriately managed can be provided.

In any one of the first to third modifications, the wrapper 41 has a basis weight of 30 to 70 g/m$^2$. According to this configuration, it is possible to provide a non-combustible heating-type smoking article in which the circumference of the tobacco part 24 can be appropriately managed due to the tensile strength being large to some extent, and in which the roundness of the tobacco part 24 does not deteriorate due to the wrapper 41 having a rigidity (Clark stiffness) that is not too large.

In this case, the wrapper 41 has a thickness of 35 to 80 μm. According to this configuration, the wrapper 41 is not too thin, which can reduce the possibility of the occurrence of breakage in the wrapper 41. In addition, the wrapper 41 is not too thick, which can prevent the deterioration of the roundness due to the increase in rigidity (Clark stiffness) of the wrapper 41.

In this case, the wrapper 41 has a whiteness of 78 to 100%, and the wrapper 41 has an opacity of 60 to 100%. According to this configuration, it is possible to improve the appearance quality of the tobacco part 24 to make the appearance similar to that of a traditional cigarette, and a non-combustible heating-type smoking article without a feeling of discomfort can be provided.

In this case, the wrapper 41 has an elongation at a break in the transverse direction of 0.1 to 8% when measured by the 18 mm method. According to this configuration, it is possible to suppress the amount of change in the circumference of the tobacco part 24 after 35 days of storage, which is a reference change amount, to 0.15 mm or less.

In this case, the wrapper 41 has a 1% stress in the transverse direction of 4 to 10 N. The value of the 1% stress is a measurement value including the initial looseness of the wrapper 41 and reflects the individual characteristics of the wrapper 41 in the early stage of change, and thus is suitable as a parameter for evaluating the resistance to stretching of the wrapper 41 in the initial state. In addition, the 1% stress is obtained by acquiring a load value when the elongation is 0.18 mm during the measurement by the 18 mm method. For example, the tobacco part 24 having a circumference of 22 to 24.5 mm is actually stretched by from 0.2 to 0.3 mm, and the 1% stress is thus appropriate as an evaluation parameter. According to the above-described configuration, it is possible to suppress the amount of change in the circumference of the tobacco part 24 after 35 days of storage, which is a reference change amount, to 0.15 mm or less.

In this case, the tobacco filler 23 is formed by being filled with a cut piece of a predetermined width of a sheet into which pulverized leaf tobacco is molded (sheet-molded material) and/or a cut rag of tobacco leaf (dried leaf) in a random orientation. According to this configuration, the arrangement of the tobacco filler 23 can be made similar to that of a traditional cigarette, and a user does not have a feeling of discomfort regarding the appearance of the tobacco part 24.

In this case, the wrapper 41 has the bonding part 45 bonding the first sheet 42 to the second sheet 43, and the bonding part 45 is a vinyl acetate-based emulsion adhesive or a starch glue. According to this configuration, the barrier effect of the bonding part 45 improves the blocking properties for the flavor component and the moisture. Thus, the second flavor component and moisture contained in the tobacco filler 23 do not penetrate the wrapper 41 to form stains. This makes it possible to prevent a defect in the appearance of the non-combustible heating-type smoking article to provide the appearance quality as designed for a user.

The non-combustible heating-type smoking article includes the filter part 26 for filtering aerosol generated from the tobacco filler 23, and a tubular connecting part 27 for connecting the filter part 26 and the wrapper 41, and the connecting part 27 has the air vent part 28. According to this configuration, it is possible to appropriately dilute the aerosol emitted from the tobacco filler 23 through the vent hole part 28, and the smoke aroma of tobacco can be delivered to a user at a concentration that suits the preference of the user.

In this case, the filter part 26 has the first segment 31 having a hollow part and the solid second segment 32 adjacent to the first segment 31. According to this configuration, it is possible to change the degree of filtration of the aerosol by changing the ratio between the length of the first segment 31 including the hollow part and the length of the solid second segment 32. Thus, when it is desired to change the concentration of the aerosol in accordance with product specifications, the length ratio between the first segment 31 and the second segment 32 can be appropriately changed, which can improve the flexibility of product design.

The electric heating-type smoking system 11 includes the above-described non-combustible heating-type smoking article and the heater 21 for heating the non-combustible heating-type smoking article. According to this configuration, it is possible to realize a non-combustible heating-type smoking article having the tobacco part 24 whose circumference is appropriately managed, and in which the positional relationship between the non-combustible heating-type smoking article and the heater 21 is stable; as a result, heating of the non-combustible heating-type smoking article can be stably performed, and aerosol according to a design value can be delivered to a user, whereby the high-quality electric heating-type smoking system 11 can be realized.

The non-combustible heating-type smoking article and the electric heating-type smoking system 11 are not limited to the above-described embodiment or each modification example and can be embodied in practice by modifying the structural elements without departing from the gist of the invention. In addition, some of the structural elements may be deleted from each of the embodiments.

EMBODIMENTS

Embodiments of the present invention are summarized below.

[1] A non-combustible heating-type smoking article including:

a tobacco part including a tobacco filler and a wrapper enclosing the tobacco filler, the tobacco part having a hardness of 0.41 to 1.5 N, preferably 0.8 to 1.4 N, and more preferably 0.94 to 1.34 N, when compressed by a length corresponding to 10% of a diameter of the tobacco part in a diameter direction of the tobacco part, the wrapper being formed by attaching two or more sheets, and the wrapper having a tensile strength of 10 to 30 N, preferably 13 to 27 N, and more preferably 14.4 to 24.9 N in a transverse direction crossing an axial direction of the tobacco part.

[2] The non-combustible heating-type smoking article according to [1], wherein the wrapper includes a first sheet made of metal and a second sheet made of paper.

[3] The non-combustible heating-type smoking article according to [2], wherein the first sheet is positioned on a side of the tobacco filler, and the second sheet is positioned outside.

[4] The non-combustible heating-type smoking article according to [2] or [3], wherein the wrapper includes a third sheet made of paper attached to a side of a second surface of the first sheet opposite to a first surface to which the second sheet 43 is attached.

[5] The non-combustible heating-type smoking article according to [1], wherein the wrapper includes a first sheet made of paper and a second sheet made of paper.

[6] The non-combustible heating-type smoking article according to any one of [1] to [5], wherein the wrapper has a basis weight of 30 to 70 g/m$^2$, preferably 35 to 65 g/m$^2$, and more preferably 38 to 60 g/m$^2$.

[7] The non-combustible heating-type smoking article according to any one of [1] to [6], wherein the wrapper has a thickness of 35 to 80 μm, preferably 35 to 75 μm, and more preferably 38 to 70 μm.

[8] The non-combustible heating-type smoking article according to any one of [1] to [7], wherein the wrapper has a whiteness of 78 to 100%, preferably 78 to 95%, and more preferably 78 to 93%.

[9] The non-combustible heating-type smoking article according to any one of [1] to [8], wherein the wrapper has an opacity of 60 to 100%, preferably 65 to 95%, and more preferably 66 to 93%.

[10] The non-combustible heating-type smoking article according to any one of [1] to [9], wherein the wrapper has an elongation at a break in the transverse direction of 0.1 to 8%, preferably 4 to 7%, and more preferably 4.4 to 6.9%.

[11] The non-combustible heating-type smoking article according to any one of [1] to [10], wherein the wrapper has a 1% stress in the transverse direction of 4 to 10 N, preferably 5 to 9 N, and more preferably 5.5 to 8.4 N.

[12] The non-combustible heating-type smoking article according to any one of [1] to [11], wherein the tobacco part has a filling density of the tobacco filler of 0.3 to 0.5 g/cc, preferably 0.35 to 0.45 g/cc, and more preferably 0.37 to 0.41 g/cc.

[13] The non-combustible heating-type smoking article according to any one of [1] to [12], wherein the tobacco part has a hardness of 80 to 95%, preferably 85 to 90%, and more preferably 85.1 to 86.4%, when measured by a conventional method.

[14] The non-combustible heating-type smoking article according to any one of [2] to [13], wherein the wrapper includes a bonding part bonding the first sheet and the second sheet, and the bonding part is a vinyl acetate-based emulsion adhesive or a starch glue.

[15] The non-combustible heating-type smoking article according to any one of [1] to [14], wherein the tobacco filler is formed by being filled with a sheet-molded material that is a sheet into which a pulverized leaf tobacco is molded and/or a cut rag of a leaf tobacco in a random orientation.

[16] The non-combustible heating-type smoking article according to any one of [1] to [15], including:

a filter part configured to filter an aerosol generated from the tobacco filler; and a tubular connecting part connecting the filter part and the wrapper, wherein the connecting part includes an air vent part.

[17] The non-combustible heating-type smoking article according to [16], wherein the filter part includes:

a first segment including a hollow part; and a solid second segment adjacent to the first segment.

[18] An electric heating-type smoking system including:

the non-combustible heating-type smoking article according to any one of [1] to [17]; and a heater configured to heat the non-combustible heating-type smoking article.

[19] The electric heating-type smoking system according to [18], including a tubular heat transfer unit provided inside the heater.

EXAMPLES

The electric heating-type smoking system 11 for the Examples was produced as follows as an example.

<Production Line of Wrapper 41>

The first sheet 42 and the second sheet 43 (and the third sheet 44 in the case of adopting the second modification) were prepared with a width of 1045 mm. Then, the second sheet 43 was bonded to one surface of the first sheet 42 using the bonding part 45. As the bonding part 45, a vinyl acetate-based emulsion adhesive was used. For the wrapper 41 taking the second modification, the second sheet 43 was bonded to the other surface of the first sheet 42 using a second bonding part 46. As the second bonding part 46, a vinyl acetate-based emulsion adhesive was used. In the manner described above, a one-piece wrapper 41 having a width of 1045 mm was formed.

Then, the wrapper 41 having the 1045 mm width was wound into a roll shape. This roll of the wrapper 41 was cut so as to have a width of 48.6 mm using a slitter.

<Tobacco Filler>

The tobacco filler 23 used was prepared by pulverizing dried tobacco leaf so as to have an average particle size of about from 20 to 200 μm, homogenizing the pulverized tobacco leaf, molding it into a sheet, and cutting the sheet into strips having a width of 0.8 mm. The resultant strips had a length of about from 1 to 40 mm. The tobacco filler 23 was made to contain 17% by weight of an aerosol-generating base material and a second flavor (menthol) based on the pulverized tobacco leaf. The content of menthol in the tobacco filler 23 was 39000 ppm. As the aerosol-generating base material, glycerin was used. The tobacco filler 23 thus configured was filled within the wrapper 41 in a random orientation.

<Cigarette Making Machine>

The wrapper 41 and the tobacco filler 23 prepared in the manner described above were used and rolled up as the tobacco part 24.

In rolling as the tobacco part 24, a cigarette making machine Protos M5 manufactured by Hauni was used. Note that since the wrapper 41 including a metal foil was used, an automatic control device in microwave transmission for tobacco filling density, built into the Protos M5, was not operated, and the tobacco filling density was manually adjusted. As a result, using the cigarette making machine, the tobacco part 24 having a circumference of 22 mm and a full length of 56 mm was produced at a rate of 5000 pieces/min. This demonstrated that the production efficiency of the tobacco part 24 of this example was relatively good. In addition, there were few samples having noticeable scratches formed on the exterior of the tobacco part 24.

<Evaluation on Increase in Circumference of Tobacco Part During Storage>

The inventors performed evaluation on the increase in the circumference of the tobacco part 24 during storage. Hereinafter, the evaluation results of Examples 1 to 3 and Comparative Examples 1 to 7 of the tobacco part 24 of the rod 14 and the wrapper 41 used for the tobacco part 24 will be described with reference to the tables of FIGS. 7 to 9.

Prior to describing the tensile strength in the longitudinal direction and the tensile strength in the transverse direction of the wrapper 41 of Example 1, an 180 mm method and an 18 mm method, which are a method for measuring a tensile strength and a method for measuring a Clark stiffness, respectively, will be described.

In the 180 mm method, tensile strength measurement was performed using a tensile strength measuring device (STRONGRAPH E3-L (trade name) manufactured by TOYO SEIKI CO., LTD.) based on JIS P 8113. Taking a piece of paper cut to 200 mm (long side)×15 mm (short side) as each test sample, the test sample was pulled at a pulling rate of 50 mm/min, and the load at the time of breaking was taken as a value of the tensile strength. That is, each test sample has a measurement portion of 180 mm excluding grip portions at both ends. At this time, the "180 mm method", so described for convenience of explanation, is widely used as one item of the standards of ordinary paper not only in the cigarette industry. In the 180 mm method, each test sample was subjected to a tensile test in the axial direction (longitudinal direction) and the transverse direction of the tobacco part 24 to measure tensile strength and elongation.

Here, for convenience of description, the following method is referred to as an 18 mm method. In the 18 mm method, a paper piece of 22 mm (transverse direction (CD direction))×10 mm (longitudinal direction (MD direction)) was prepared and subjected to a tensile test in a transverse direction crossing the axial direction of the tobacco part 24 to measure tensile strength and elongation. Each test sample had a measurement portion of 18 mm excluding grip portions at both ends. The tensile test by the 18 mm method was performed on 10 samples, and the average value thereof was used as measured values for the tensile strength and the elongation. In addition, 1% stress was calculated from the tensile test result. All the tensile tests on Examples 1 to 3 and Comparative Examples 1 to 7 in the 18 mm method were performed at a tensile speed of 50 mm/min using a rheometer manufactured by SUN SCIENTIFIC CO., LTD., model number CR-3000EX-L. In the Examples, since the vertical and horizontal dimension of the wrapper 41 were close to the dimension of the wrapper 41 of the non-combustible heating-type smoking article as an actual product, not only the measurement by the above 180 mm method but also the measurement by the 18 mm method was performed. The measurement of tensile strength and elongation by the 18 mm method was performed using the wrapper 41 in the state before being actually rolled up as the tobacco part 24. Note that the tensile strength, elongation, and 1% stress referred to in the claims are all values calculated from measured values measured by the 18 mm method and measured values measured by the 18 mm method.

The measurement of the Clark stiffness was performed based on JIS P 8143. For the measurement of the Clark stiffness, a digital Clark flexibility tester manufactured by TOYO SEIKI CO., LTD was used. In the measurement of Clark stiffness, paper cut to 200 mm in the longitudinal direction (MD direction)×30 mm in the transverse direction (CD direction) was used as each test sample. The measurement of Clark stiffness, and measurement of tensile strength and elongation by the 180 mm method were performed using the wrapper 41 in the state before being actually rolled up as the tobacco part 24.

A new method and a conventional method for measuring the hardness (cigarette hardness) of the tobacco part 24 will be described.

Figures 9, 10:
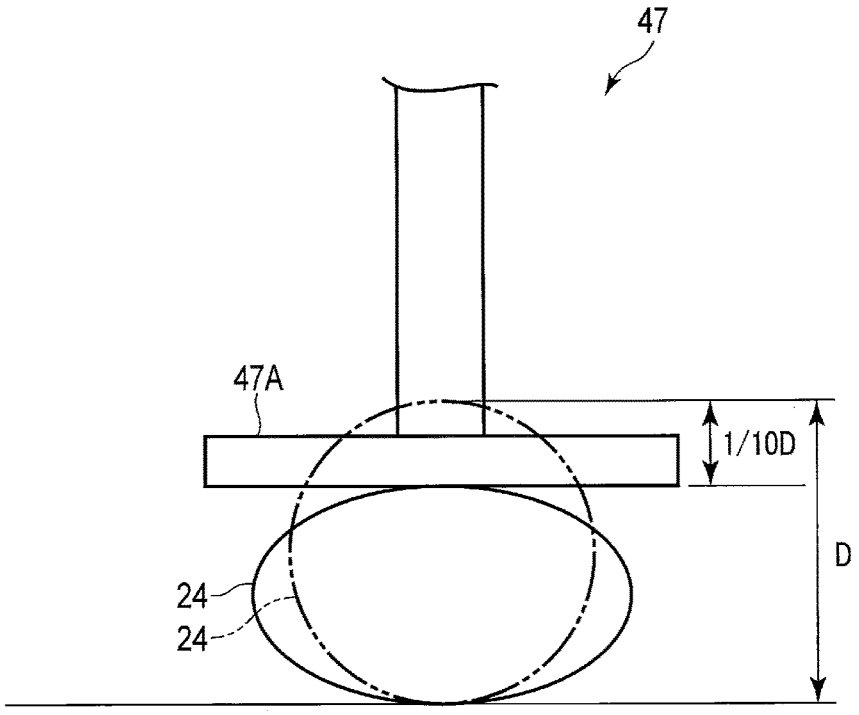
FIG. 9 is a table showing results on the amount of change in circumference of the tobacco part of Examples 1 to 3 and Comparative Examples 1 to 7.
FIG. 10 is a schematic diagram illustrating a process of measuring hardness (cigarette hardness) of a tobacco part by a new method using a rheometer.

Since the tobacco part of the electric heating-type smoking system is often shorter in the axial direction than the conventional tobacco rod, the following method was used for the measurement. This is referred to herein as the new method. In the new method, as shown in FIG. 10, when the tobacco part 24 is compressed (displaced) in the diameter direction of the tobacco part 24 by the length corresponding to 10% of a diameter D of the tobacco part 24, i.e., 1/10D, the repulsive force acting on a push rod 47A of the rheometer 47 is defined as a hardness (cigarette hardness) of tobacco part 24. For the measurement of the hardness of the tobacco part 24 in the new method, a rheometer manufactured by SUN SCIENTIFIC CO., LTD., model number CR-3000EX-L was used. For the push rod 47A, a rod configured of a jig made of stainless steel and having a disk-shaped contact portion with a diameter of 10 mm at the tip thereof (model number: adapter (pressure-sensitive shaft) NO1) was used. The moving speed of the push rod 47A of the rheometer 47 was set to 50 mm/min. In the following Examples, when the hardness of the tobacco part 24 is measured by the new method, the length of the tobacco part 24 in the axial direction was set to 10 mm. In the new method, 10 samples were measured, and the average value thereof was taken as a measurement result by the new method.

For the sake of convenience, the method widely applied to the measurement of cigarette hardness of tobacco products and filter products is referred to as the conventional method in the present specification. In the conventional method, the hardness of the tobacco part 24 is measured by, for example, the method described in Jpn. PCT National Publication No. 2016-523565. In the conventional method, a cigarette hardness measurement instrument D37AJ manufactured by Borgward was used to simultaneously apply a load F of 2 kg weight from above to below on ten tobacco parts 24 horizontally placed side by side. After applying the load F for 5 seconds, the load F was removed and the average diameter of the tobacco part 24 was measured. The hardness (%) is represented by the following equation.

$$\text{Hardness (\%)}=100\times(D_d(\text{average strain amount}))/(D_s(\text{target diameter}))$$

In the equation, $D_d$ is a diameter of the tobacco part 24 that has decreased after the application of the load F, and $D_s$ is a diameter of the tobacco part 24 before the application of the load F. In the conventional method, ten samples for each time were measured ten times (100 samples in total), and the average value of the ten measurement results was taken as a measurement result by the conventional method. Note that in Jpn. PCT National Publication No. 2016-523565, the conventional method is used in order to measure the hardness of the filter, while in the present embodiment, the conventional method is used in order to measure the hardness (cigarette hardness) of the tobacco part 24. The hardness of the tobacco part referred to in the claims is a measured value measured by the new method.

In addition, the amount of change in the circumference of the tobacco part 24 (the amount of change in roll circumference) during storage of the tobacco part 24 of the produced rod 14 was measured. The circumference was measured by an outer circumference method with a roll quality measuring device SODIMAX (manufactured by SODIM). Specifically, the shadow of the tobacco part 24 was detected by a laser optical measuring device, and its diameter was measured. During one rotation of the tobacco part 24, the diameters at 1024 points were measured to obtain an average diameter, and the circumference was calculated by the diameter x n. The relative ellipticity $D_o$ was calculated by the following equation, and the roundness of the tobacco part 24 was displayed. The relative ellipticity $D_o$ is represented by:

$$D_o=(D_{max}-D_{min})/D\text{ave}\times 100\%.$$

In the equation, $D_{max}$ is a maximum diameter, $D_{min}$ is a minimum diameter, and $D_{ave}$ is an average diameter.

Example 1

As the wrapper 41, the wrapper 41 in the above first modification (the first sheet 42: aluminum foil; the second sheet 43: paper) was used. The aluminum foil for the first sheet 42 had a thickness of 6 μm. As the paper for the second sheet 43, paper having a basis weight of 20 g/m$^2$ was used. As the bonding part 45, a vinyl acetate-based emulsion adhesive was used. The tobacco part 24 and the wrapper 41 of Example 1 were prepared according to the specifications in the tables shown in FIGS. 7 to 9. The density (roll density) of the tobacco filler 23 of Example 1 was 0.41 g/cc.

The cigarette hardness of the tobacco part 24 measured by the new method was 1.34 N. The cigarette hardness of the tobacco part 24 measured by the conventional method was 86.4%.

Example 1 had a whiteness of 78% and an opacity of 93%. By setting the whiteness to 78% or more and the opacity to 60% or more in this way, an appearance similar to that of a traditional cigarette was attained, and a user will not have a feeling of discomfort. Using a whiteness/opacity measuring machine (manufacturer: Murakami Color Research Laboratory, model number: WMS-1), whiteness was measured according to ISO2470 and opacity was measured according to ISO2471. The opacity was calculated by the following equation:

$$\text{Opacity}=\text{single sheet luminous reflectance coefficient }(R0)/\text{intrinsic luminous reflectance coefficient }(R\infty)\times 100(\%).$$

In the equation, the intrinsic luminous reflectance coefficient (R∞) is an intrinsic reflectance coefficient of whiteness measured under spectroscopic conditions with an effective wavelength 457 nm and a width at half maximum of 44 nm using a specified reflectometer and light source.

The wrapper 41 had a tensile strength of 14.4 N in the transverse direction crossing the axial direction of the tobacco part 24 when measured by the 18 mm method. The wrapper 41 had a tensile strength of 20.2 N in the transverse direction crossing the axial direction of the tobacco part 24 when measured by the 18 mm method.

The wrapper 41 had an elongation at a break of 4.4% in the transverse direction when measured by the 18 mm method. The wrapper 41 had an elongation at a break of 2.8% in the transverse direction when measured by the 180 mm method.

The stress (1% stress) when the wrapper 41 was elongated by 1% was 5.5 N in the transverse direction as measured by the 18 mm method.

The change in the circumference of the tobacco part 24 during storage will be described below. Note that in the evaluation of each Example, the amount of increase in circumference at the time of day 35 of the storage period was set to 0.16 mm or less as a level at which no defect arose in inserting the rod into the insertion part of the main body. The results were as follows. After 5 days and 18 days, the circumference of the tobacco part 24 increased by 0.04 mm from the original tobacco part circumference; after 35 days, the circumference of the tobacco part 24 increased by 0.03 mm from the original tobacco part circumference; after 63 days, the circumference of the tobacco part 24 increased by 0.04 mm from the original tobacco part circumference; after 96 days, the circumference of the tobacco part 24 increased by 0.03 mm from the original tobacco part circumference. Therefore, although the circumference of the tobacco part 24 increased by about 0.04 mm in 5 days from the start of the storage, almost no change was observed in the circumference of the tobacco part 24 after the storage. In addition, in Example 1, it was found that the amount of increase in circumference was equal to or less than the reference value because the amount of increase in circumference at the time when 35 days as a reference elapsed was 0.16 mm or less.

Example 2

As the wrapper 41, the wrapper 41 in the above second modification (the first sheet 42: aluminum foil; the second sheet 43: paper; the third sheet 44: paper) was used. The aluminum foil for the first sheet 42 had a thickness of 6 μm. As the paper for the second sheet 43 and the third sheet 44, paper having a basis weight of 20 g/m$^2$ was used. As the bonding part 45 and the second bonding part 46, a vinyl acetate-based emulsion adhesive was used. The tobacco part 24 and the wrapper 41 of Example 2 were prepared according to the specifications in the tables shown in FIGS. 7 to 9. The density (roll density) of the tobacco filler 23 of Example 2 was 0.37 g/cc.

The cigarette hardness of the tobacco part 24 measured by the new method was 0.94 N. The cigarette hardness of the tobacco part 24 measured by the conventional method was 85.1%.

Example 2 had a whiteness of 93% and an opacity of 87%. Thus, an appearance similar to that of a traditional cigarette was attained, and a user will not have a feeling of discomfort.

The wrapper 41 had a tensile strength of 14.5 N in the transverse direction crossing the axial direction of the tobacco part 24 when measured by the 18 mm method. The wrapper 41 had a tensile strength of 25.7 N in the transverse direction crossing the axial direction of the tobacco part 24 when measured by the 180 mm method.

The wrapper 41 had an elongation at a break of 6.0% in the transverse direction when measured by the 18 mm method. The wrapper 41 had an elongation at a break of 3.2% in the transverse direction when measured by the 180 mm method.

The stress (1% stress) when the wrapper 41 is elongated by 1% was 7.0 N in the transverse direction as measured by the 18 mm method.

The change in the circumference of the tobacco part 24 during storage will be described below. After 5 days, the circumference of the tobacco part 24 increased by 0.04 mm from the original tobacco part circumference; after 18 days, the circumference of the tobacco part 24 increased by 0.03 mm from the original tobacco part circumference; after 35 days, the circumference of the tobacco part 24 increased by 0.04 mm from the original tobacco part circumference; after 63 days, the circumference of the tobacco part 24 increased by 0.06 mm from the original tobacco part circumference; after 96 days, the circumference of the tobacco part 24 increased by 0.03 mm from the original tobacco part circumference. Therefore, although the circumference of the tobacco part 24 increased by about 0.04 mm in 5 days from the start of the storage, almost no change was observed in the circumference of the tobacco part 24 after the storage. In addition, in Example 2, it was found that the amount of increase in circumference was equal to or less than the reference value because the amount of increase in circumference at the time when 35 days as a reference elapsed was 0.16 mm or less. Note that the decrease in the amount of change in circumference after 96 days is considered to result from a measurement error.

Example 3

As the wrapper 41, the wrapper 41 in the above third modification (the first sheet 42: paper; the second sheet 43: paper) was used. As the paper for the first sheet 42 and the second sheet 43, paper having a basis weight of 20 g/m$^2$ was used. As the bonding part 45, a vinyl acetate-based emulsion adhesive was used. The tobacco part 24 and the wrapper 41 of Example 3 were prepared according to the specifications in the tables shown in FIGS. 7 to 9. The density (roll density) of the tobacco filler 23 of Example 3 was 0.37 g/cc.

The cigarette hardness of the tobacco part 24 measured by the new method was 1.07 N. The cigarette hardness of the tobacco part 24 measured by the conventional method was 85.1%.

Example 3 had a whiteness of 80% and an opacity of 66%. Thus, an appearance similar to that of a traditional cigarette was attained, and a user will not have a feeling of discomfort.

The wrapper 41 had a tensile strength of 24.9 N in the transverse direction crossing the axial direction of the tobacco part 24 when measured by the 18 mm method. The wrapper 41 had a tensile strength of 34.9 N in the transverse direction crossing the axial direction of the tobacco part 24 when measured by the 180 mm method.

The wrapper 41 had an elongation at a break of 6.9% in the transverse direction when measured by the 18 mm method. The wrapper 41 had an elongation at a break of 4.2% in the transverse direction when measured by the 180 mm method.

The stress (1% stress) when the wrapper 41 was elongated by 1% was 8.4 N in the transverse direction as measured by the 18 mm method.

The change in the circumference of the tobacco part 24 during storage will be described below. After 5 days and 18 days, the circumference of the tobacco part 24 increased by 0.04 mm from the original tobacco part circumference; after 18 days, the circumference of the tobacco part 24 increased by 0.04 mm from the original tobacco part circumference; after 35 days, the circumference of the tobacco part 24 increased by 0.04 mm from the original tobacco part circumference; after 63 days, the circumference of the tobacco part 24 increased by 0.05 mm from the original tobacco part circumference; after 96 days, the circumference of the tobacco part 24 increased by 0.05 mm from the original tobacco part circumference. Therefore, although the circumference of the tobacco part 24 increased by about 0.04 mm in 5 days from the start of the storage, almost no change was observed in the circumference of the tobacco part 24 after the storage. In addition, in Example 3, it was found that the amount of increase in circumference was equal to or less than the reference value because the amount of increase in circumference at the time when 35 days as a reference elapsed was 0.16 mm or less.

Example 4

Example 4 is not shown in the tables of FIGS. 7 to 9. As the wrapper 41, the wrapper 41 in the above first form (the first sheet 42: aluminum foil; the second sheet 43: paper) was used. The aluminum foil for the first sheet 42 had a thickness of 6 μm. As the paper for the second sheet 43, paper having a basis weight of 30 g/m$^2$ was used. As the bonding part 45, a vinyl acetate-based emulsion adhesive was used.

The wrapper 41 had a tensile strength of 14.4 N in the transverse direction when measured by the 18 mm method. The wrapper 41 had an elongation at a break of 6% in the transverse direction when measured by the 18 mm method. The stress (1% stress) when the wrapper 41 was elongated by 1% was 7.6 N in the transverse direction as measured by the 18 mm method.

Comparative Examples 1 to 3

For the wrapper 41, paper having a basis weight of 26 g/m$^2$, used for traditional cigarettes, was used. The tobacco part 24 and the wrapper 41 of Comparative Example 1 were prepared according to the specifications in the tables shown in FIGS. 7 to 9. Comparative Example 1 had a circumference of 24.5 mm, and Comparative Example 2 and Comparative Example 3 had a circumference of 22.0 mm.

Comparative Example 1 and Comparative Example 2 had a density (roll density) of the tobacco filler 23 of 0.21 g/cc, and Comparative Example 3 had a roll density of 0.37 g/cc.

The cigarette hardness of the tobacco part 24 measured by the new method was 0.40 N for Comparative Example 1, 0.39 N for Comparative Example 2, and 0.85 N for Comparative Example 3. The cigarette hardness of the tobacco part 24 measured by the conventional method was 74.0% for Comparative Example 1, 72.0% for Comparative Example 2, and 77.9% for Comparative Example 3.

Comparative Examples 1 to 3 had a whiteness of 89% and an opacity of 76%. Thus, an appearance similar to that of a traditional cigarette was attained, and a user will not have a feeling of discomfort.

The wrapper 41 had a tensile strength of 5.7 N in the transverse direction when measured by the 18 mm method. The wrapper 41 had a tensile strength of 7.2 N in the transverse direction when measured by the 180 mm method.

The wrapper 41 had an elongation at a break of 10.9% in the transverse direction when measured by the 18 mm method. The wrapper 41 had an elongation at a break of 6.0% in the transverse direction when measured by the 180 mm method.

The stress (1% stress) when the wrapper 41 was elongated by 1% was 1.4 N in the transverse direction as measured by the 18 mm method.

The change in the circumference of the tobacco part 24 during storage will be described below. In Comparative Examples 1 and 2, after 5 days, the circumference of the tobacco part 24 increased by 0.04 mm from the original tobacco part circumference; after 18 days, the circumference of the tobacco part 24 increased by 0.03 mm from the original tobacco part circumference; after 35 days, the circumference of the tobacco part 24 increased by 0.04 mm from the original tobacco part circumference; after 63 days and 96 days, the circumference of the tobacco part 24 increased by 0.03 mm from the original tobacco part circumference. Thus, in Comparative Examples 1 and 2, since the amount of increase in circumference at the time when 35 days as a reference elapsed was 0.16 mm or less, the amount of increase in circumference was found to be equal to or less than the reference value. However, due to the low filling density of the tobacco filler 23 with respect to the tobacco part 24, aroma and taste were insufficient when smoked as an electrically heated smoking system 11, causing a user to feel some dissatisfaction.

In Comparative Example 3, after 5 days, the circumference of the tobacco part 24 increased by 0.15 mm from the original tobacco part circumference; after 18 days, the circumference of the tobacco part 24 increased by 0.23 mm from the original tobacco part circumference; after 35 days, the circumference of the tobacco part 24 increased by 0.24 mm from the original tobacco part circumference; after 63 days, the circumference of the tobacco part 24 increased by 0.26 mm from the original tobacco part circumference; after 96 days, the circumference of the tobacco part 24 increased by 0.27 mm from the original tobacco part circumference. Therefore, in Comparative Example 3, it was found that the circumference of the tobacco part 24 gradually increased with the passage of time. In addition, in Comparative Example 3, it was found that the standard of storage stability was not satisfied because the amount of increase in circumference at the time of the lapse of 35 days as a reference exceeded 0.16 mm.

Comparative Example 4

For the wrapper 41, paper having a high basis weight (a basis weight of 35 g/m$^2$, a filler (blending amount of calcium carbonate) 35%) was used. The tobacco part 24 and the wrapper 41 of Comparative Example 4 were prepared according to the specifications in the tables shown in FIGS. 7 to 9.

The density (roll density) of the tobacco filler 23 of Comparative Example 4 was 0.37 g/cc.

The cigarette hardness of the tobacco part 24 measured by the new method was 0.67 N. The cigarette hardness of the tobacco part 24 measured by the conventional method was 79.7%.

Comparative Example 4 had a whiteness of 94% and an opacity of 83%. Thus, an appearance similar to that of a traditional cigarette was attained, and a user will not have a feeling of discomfort.

The wrapper 41 had a tensile strength of 6.6 N in the transverse direction when measured by the 18 mm method. The wrapper 41 had a tensile strength of 8.0 N in the transverse direction when measured by the 180 mm method.

The wrapper 41 has an elongation at a break of 6.2% in the transverse direction when measured by the 18 mm method. The wrapper 41 has an elongation at a break of 4.4% in the transverse direction when measured by the 180 mm method.

The stress (1% stress) when the wrapper 41 was elongated by 1% was 4.0 N in the transverse direction as measured by the 18 mm method.

The change in the circumference of the tobacco part 24 during storage will be described below. After 5 days, the circumference increased by 0.13 mm from the original circumference; after 18 days, the circumference increased by 0.23 mm from the original circumference; after 35 days, the circumference increased by 0.25 mm from the original circumference; after 63 days, the circumference increased by 0.26 mm from the original circumference; after 96 days, the circumference increased by 0.27 mm from the original circumference. Therefore, in Comparative Example 4, it was found that the circumference of the tobacco part 24 gradually increased with the passage of time. In addition, in Comparative Example 4, it was found that the standard of storage stability was not satisfied because the amount of increase in circumference at the time of the lapse of 35 days as a reference exceeded 0.16 mm.

Comparative Example 5

For the wrapper 41, paper having a high air permeability (30000 CU) was used. The tobacco part 24 and the wrapper 41 of Comparative Example 5 were prepared according to the specifications in the tables shown in FIGS. 7 to 9.

The density (roll density) of the tobacco filler 23 of Comparative Example 5 was 0.36 g/cc.

The cigarette hardness of the tobacco part 24 measured by the new method was 0.61 N. The cigarette hardness of the tobacco part 24 measured by the conventional method was 77.7%.

Comparative Example 5 had a whiteness of 80% and an opacity of 34%. Accordingly, although the whiteness was 78% or more, the opacity was less than 60%; the appearance thus was not similar to that of a traditional cigarette, which made a user have a feeling of discomfort.

The wrapper 41 had a tensile strength of 4.8 N in the transverse direction when measured by the 18 mm method. The wrapper 41 had a tensile strength of 7.0 N in the transverse direction when measured by the 180 mm method.

The wrapper 41 had an elongation at a break of 4.9% in the transverse direction when measured by the 18 mm method. The wrapper 41 had an elongation at a break of 4.0% in the transverse direction when measured by the 180 mm method.

The stress (1% stress) when the wrapper 41 was elongated by 1% was 2.0 N in the transverse direction as measured by the 18 mm method.

The change in the circumference of the tobacco part 24 during storage will be described below. After 5 days, the circumference of the tobacco part 24 increased by 0.14 mm from the original tobacco part circumference; after 18 days, the circumference of the tobacco part 24 increased by 0.17 mm from the original tobacco part circumference; after 35 days, the circumference of the tobacco part 24 increased by 0.18 mm from the original tobacco part circumference; after 63 days, the circumference of the tobacco part 24 increased by 0.19 mm from the original tobacco part circumference; after 96 days, the circumference of the tobacco part 24 increased by 0.19 mm from the original tobacco part circumference. Therefore, in Comparative Example 5, it was found that the circumference of the tobacco part 24 gradually increased with the passage of time. In addition, in Comparative Example 5, it was found that the standard of storage stability was not satisfied because the amount of increase in circumference at the time of the lapse of 35 days as a reference exceeded 0.16 mm.

Comparative Example 6

For the wrapper 41, an aluminum foil having a thickness of 6 μm was used. The tobacco part 24 and the wrapper 41 of Comparative Example 6 were prepared according to the specifications in the tables shown in FIGS. 7 to 9. Note that in Comparative Example 6, it was impossible to evaluate the density (roll density) of the tobacco filler 23 and the cigarette hardness of the tobacco part 24 because the tobacco filler 23 could not be rolled up with the wrapper 41, which was aluminum foil.

Comparative Example 6 had a whiteness of 23% and an opacity of 100%. Accordingly, although the opacity was 60% or more, the whiteness was less than 78%; the appearance thus was not similar to that of a traditional cigarette, which made a user have a feeling of discomfort.

The wrapper 41 had a tensile strength of 3.9 N in the transverse direction when measured by the 18 mm method. The wrapper 41 had a tensile strength of 5.4 N in the transverse direction when measured by the 180 mm method.

The wrapper 41 had an elongation at a break of 2.7% in the transverse direction when measured by the 18 mm method. The wrapper 41 had an elongation at a break of 1.9% in the transverse direction when measured by the 180 mm method.

The stress (1% stress) when the wrapper 41 was elongated by 1% was 2.7 N in the transverse direction as measured by the 18 mm method.

Regarding the amount of change in the circumference of the tobacco part 24 during storage, the evaluation thereof was impossible because the tobacco filler 23 could not be rolled up with the wrapper 41, which was aluminum foil.

Comparative Example 7

For the wrapper 41, paper having a high basis weight (a basis weight of 35 g/m$^2$, a filler: 0%) was used. The tobacco part 24 and the wrapper 41 of Comparative Example 7 were prepared according to the specifications in the tables shown in FIGS. 7 to 9.

The density (roll density) of the tobacco filler 23 of Comparative Example 7 was 0.37 g/cc.

The cigarette hardness of the tobacco part 24 measured by the new method was 0.83 N. The cigarette hardness of the tobacco part 24 measured by the conventional method was 81%.

Comparative Example 7 had a whiteness of 81% and an opacity of 56%. Accordingly, although the whiteness was 78% or more, the opacity was less than 60%; the appearance thus was not similar to that of a traditional cigarette, which made a user have a feeling of discomfort.

The wrapper 41 had a tensile strength of 17.6 N in the transverse direction when measured by the 18 mm method. The wrapper 41 had a tensile strength of 24 N in the transverse direction when measured by the 180 mm method.

The wrapper 41 had an elongation at a break of 5.6% in the transverse direction when measured by the 18 mm method. The wrapper 41 had an elongation at a break of 3% in the transverse direction when measured by the 180 mm method.

The stress (1% stress) when the wrapper 41 was elongated by 1% was 7.0 N in the transverse direction as measured by the 18 mm method.

The change in the circumference of the tobacco part 24 during storage will be described below. After 5 days, the circumference of the tobacco part 24 increased by 0.04 mm from the original tobacco part circumference; after 18 days, the circumference of the tobacco part 24 increased by 0.04 mm from the original tobacco part circumference; after 35 days, the circumference of the tobacco part 24 increased by 0.04 mm from the original tobacco part circumference; after 63 days, the circumference of the tobacco part 24 increased by 0.04 mm from the original tobacco part circumference; after 96 days, the circumference of the tobacco part 24 increased by 0.05 mm from the original tobacco part circumference. Therefore, although the circumference of the tobacco part 24 increased by about 0.04 mm in 5 days from the start of the storage, almost no change was observed in the circumference of the tobacco part 24 after the storage. In addition, in Comparative Example 7, it was found that the amount of increase in circumference was equal to or less than the reference value because the amount of increase in circumference at the time when 35 days as a reference elapsed was 0.16 mm or less.

Discussion

Figure 11:
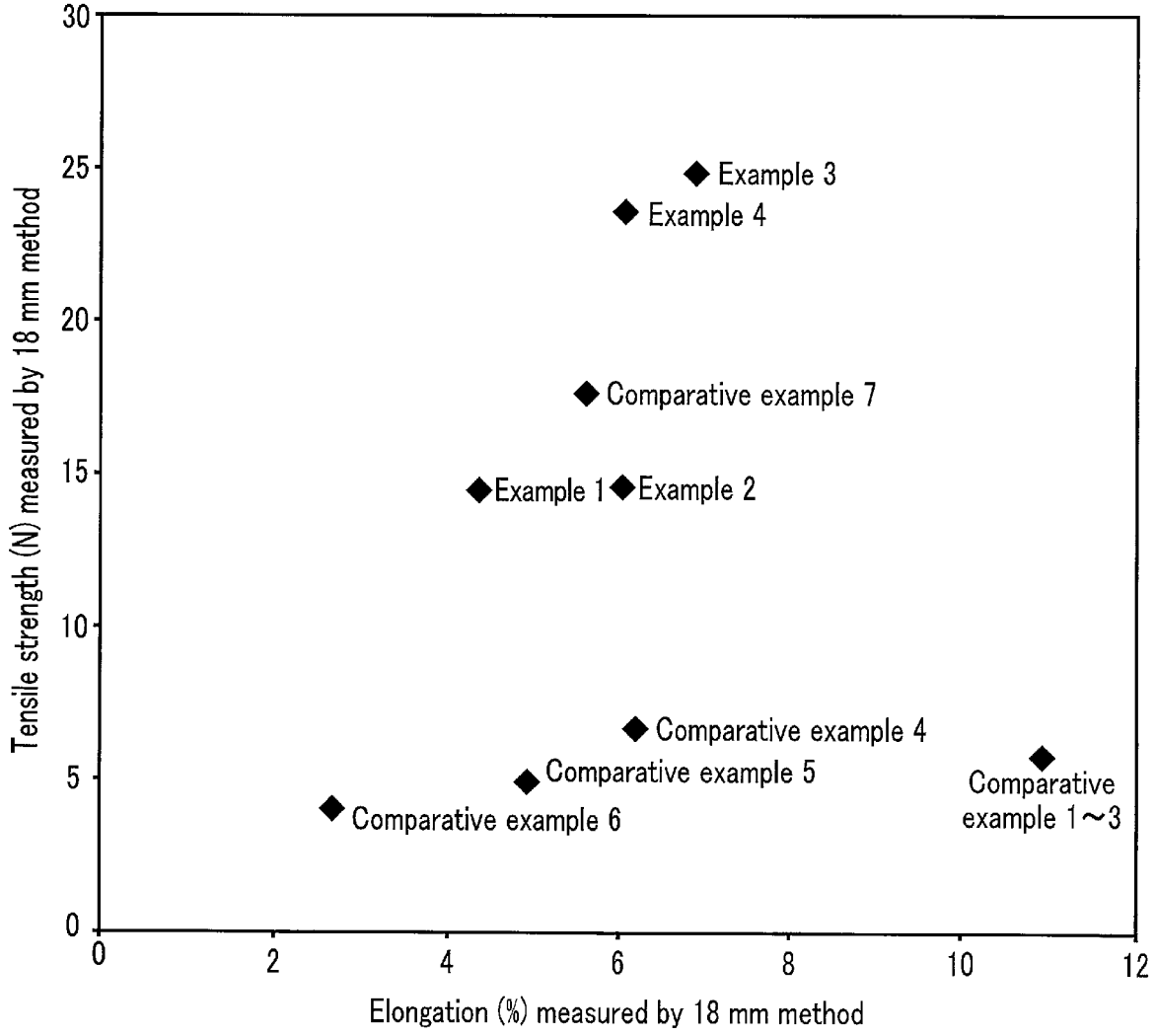
FIG. 11 is a graph showing a relationship between a tensile strength and an elongation in a transverse direction according to an 18 mm method for Examples 1 to 4 and Comparative Examples 1 to 7.

FIG. 11 shows a graph representing a relationship between an elongation (%) and a tensile strength in the transverse direction according to the 18 mm method for Examples 1 to 4 and Comparative Examples 1 to 7. As shown in this figure, it was found that the distribution for Examples 1 to 4 was clearly different from the distribution for Comparative Examples 1 to 6. Therefore, it can be understood that in order to prevent the circumference of the tobacco part 24 from increasing and to appropriately manage the circumference of the tobacco part 24 even during storage, the tensile strength according to the 18 mm method will preferably fall within the range of 10 to 30 N. Likewise, it can be understood that in order to appropriately manage the circumference of the tobacco part 24 even during storage, the elongation in the transverse direction according to the 18 mm method will preferably fall within the range of 0.1 to 8%.

Note that Comparative Example 7 had a whiteness of 81% and an opacity of 56%. Accordingly, although the whiteness was 78% or more, the opacity was less than 60%; the appearance thus was not similar to that of a traditional cigarette, which made a user have a feeling of discomfort. Thus, it was difficult to employ it for an actual product.

Figure 12:
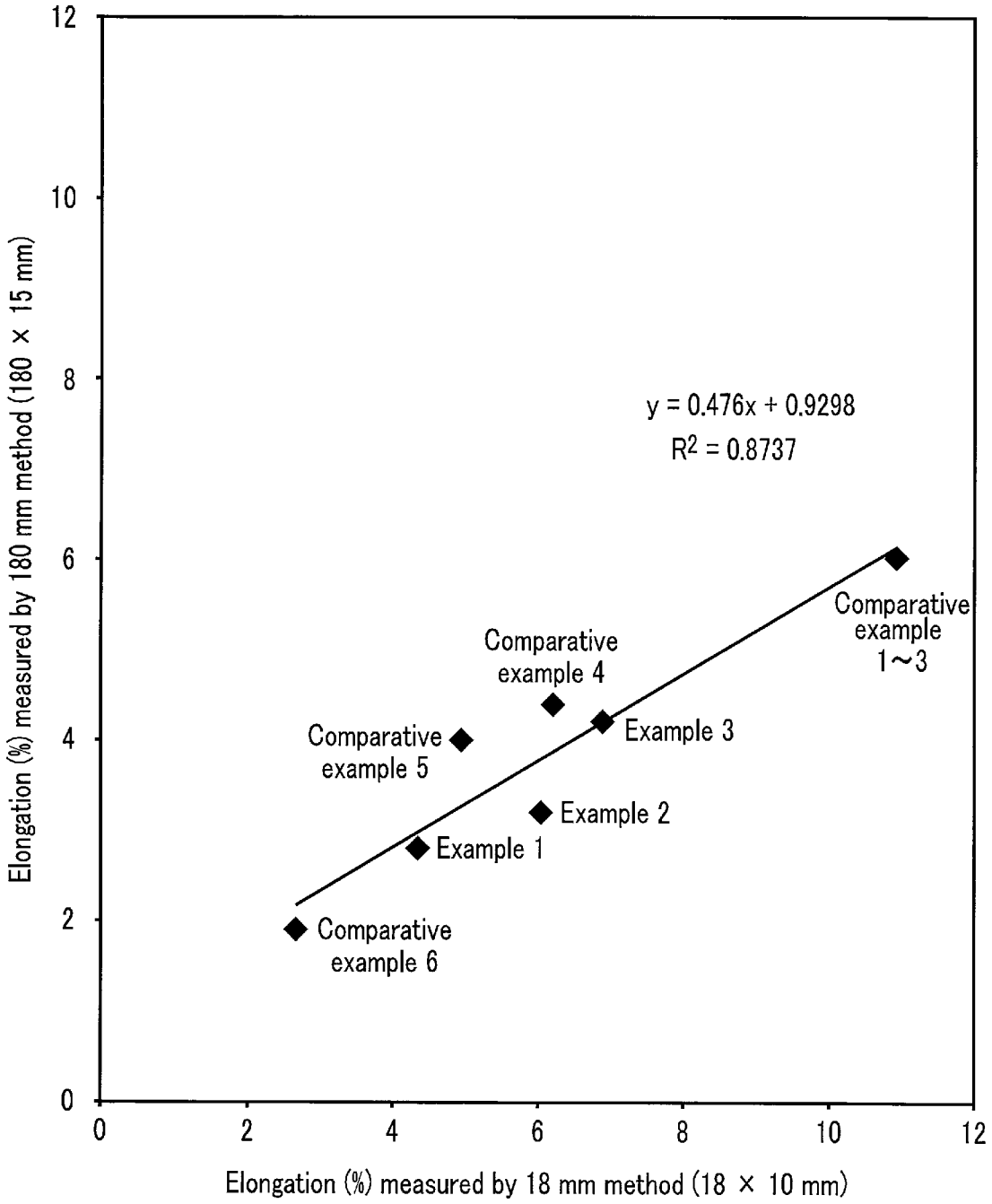
FIG. 12 is a graph showing a relationship between an elongation in a transverse direction according to an 18 mm method and an elongation in a transverse direction according to an 180 mm method for Examples 1 to 3 and Comparative Examples 1 to 6.

FIG. 12 shows a graph representing a relationship between an elongation (%) in the transverse direction according to the 18 mm method and an elongation (%) in the transverse direction according to the 180 mm method for Examples 1 to 3 and Comparative Examples 1 to 6. According to this, it can be seen that there is an approximately positive correlation between the elongation in the transverse direction according to the 18 mm method and the elongation in the transverse direction by the 180 mm method.

<Evaluation of Tensile Strength of Wrapper of Cigarette and Wrapper Before Rolling>

The inventors measured the tensile strength, elongation, and 1% stress of the wrapper 41 actually rolled up as the tobacco part 24 by the 18 mm method. FIG. 13 shows these results and again shows the tensile strength, elongation, and 1% stress of the wrapper 41 before being rolled up (before rolling) as the above-described tobacco part 24, and the difference therebetween was examined.

Example 1*

In Example 1*, the same wrapper 41 as the wrapper 41 used in the evaluation of Example 1 above was actually rolled up as the tobacco part 24 to obtain a cigarette. After storage for 4 weeks in an environment of a room temperature of 22° C. and a humidity of 60%, the wrapper 41 was removed from the tobacco part 24 again, and the tensile strength and the elongation were measured and the 1% stress was calculated by the 18 mm method in the same manner and using the same device as in Example 1.

As a result, as shown in FIG. 13, the tensile strength according to the 18 mm method was 14.5 N in the transverse direction. The elongation according to the 18 mm method was 4.7% in the transverse direction. The 1% stress according to the 18 mm method was 6.58 N in the transverse direction.

Comparative Example 1*

In Comparative Example 1* as well, the same wrapper 41 as the wrapper 41 used in the evaluation of Comparative Example 1 above was actually rolled up as the tobacco part 24 to obtain a cigarette. After storage for 4 weeks in an environment of a room temperature of 22° C. and a humidity of 60%, the wrapper 41 was removed from the tobacco part 24 again, and the tensile strength and the elongation were measured and the 1% stress was calculated, by the 18 mm method in the same manner and using the same device as in Comparative Example 1.

As a result, as shown in FIG. 13, the tensile strength according to the 18 mm method was 2.7 N in the transverse direction. The elongation according to the 18 mm method was 8.3% in the transverse direction. The 1% stress according to the 18 mm method was 0.74 N in the transverse direction.

Comparative Example 4*

In Comparative Example 4* as well, the same wrapper 41 as the wrapper 41 used in the evaluation of Comparative Example 4 above was actually rolled up as the tobacco part 24 to obtain a cigarette. After storage for 4 weeks, the wrapper 41 was removed from the tobacco part 24 again, and the tensile strength and the elongation were measured and the 1% stress was calculated by the 18 mm method in the same manner and using the same device as in Comparative Example 1.

As a result, as shown in FIG. 13, the tensile strength according to the 18 mm method was 2.3 N in the transverse direction. The elongation according to the 18 mm method was 6.1% in the transverse direction. The 1% stress according to the 18 mm method was 0.52 N in the transverse direction.

Discussion

Figure 14:
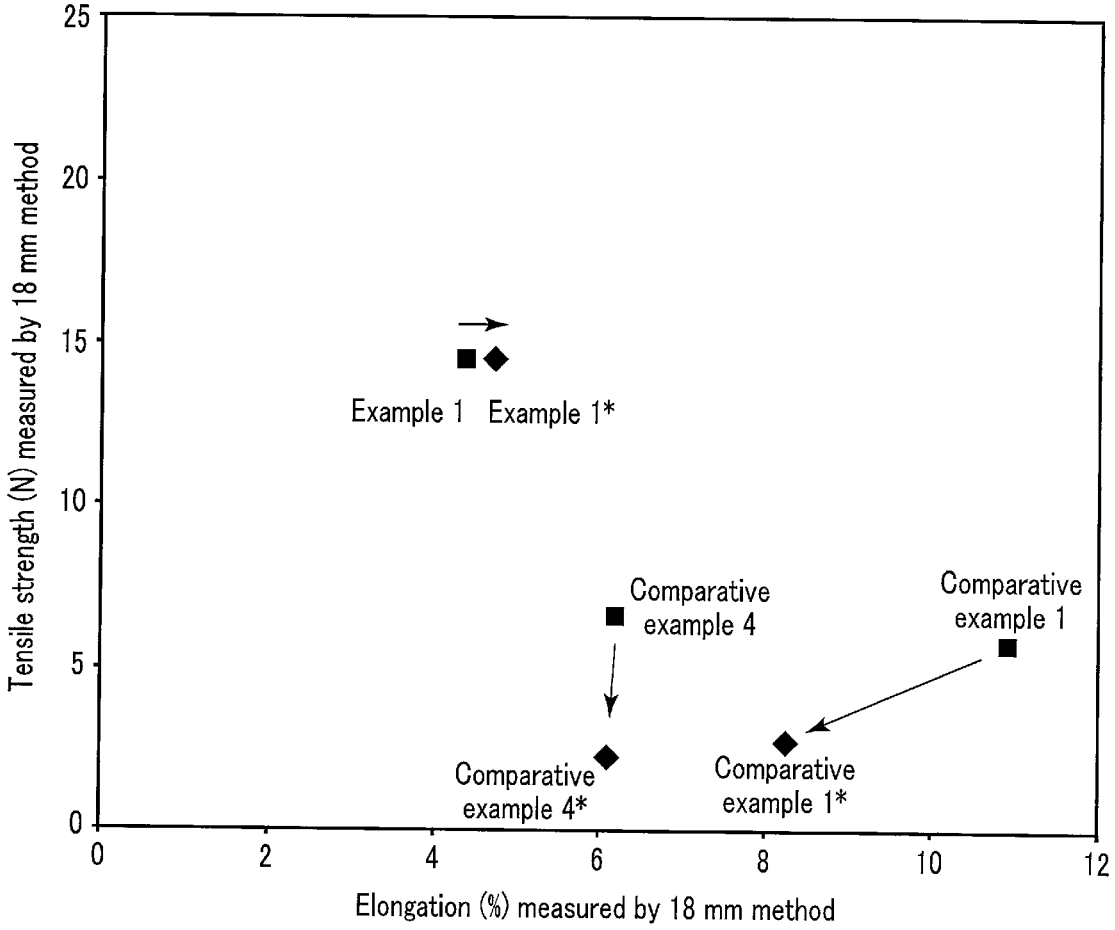
FIG. 14 is a graph showing a relationship between tensile strength/elongation in a transverse direction according to an 18 mm method for Example 1, Comparative Example 1, and Comparative Example 4 before rolling and tensile strength/elongation in a transverse direction according to an 18 mm method for Example 1*, Comparative Example 1*, and Comparative Example 4* as cigarettes.

In FIG. 14, the tensile strength and the elongation of the wrapper 41 before being rolled up as the tobacco part 24 (before rolling) are shown as Example 1, Comparative Example 1, and Comparative Example 4. In addition, the tensile strength and the elongation of the wrapper 41 rolled up as the tobacco part 24 to obtain a cigarette and removed again from the tobacco part 24 after the storage for 4 weeks in an environment of a room temperature of 22° C. and a humidity of 60%, are shown as Example 1*, Comparative Example 1*, and Comparative Example 4*.

As shown in FIG. 14, it was found that Comparative Example 1 and Comparative Example 4 had the tensile strength greatly decreased when made into the cigarettes of Comparative Example 1* and Comparative Example 4*, respectively. On the other hand, Example 1, even when made into the cigarette of Example 1*, had neither the tensile strength nor the elongation varying greatly. This can be considered as follows, for example.

For example, paper having such a low tensile strength that the tensile strength according to the 18 mm method is lower than 10 N tends to have the tensile strength reduced due to the influence of flavor components, moisture, or the like diffused from the tobacco filler 23 or the like during storage.

However, when the tensile strength is relatively large as in Example 1, for example, when the wrapper 41 has a tensile strength of 10 N or more, it is expected that there will be almost no change in the tensile strength and the elongation before and after storage. Thus, it can be understood that when the wrapper 41 has a tensile strength of 10 N or more as in Examples 1 to 4, the tensile strength and the elongation does not deteriorate due to the storage. Thus, the rod 14 (non-combustible heating-type smoking article) including the tobacco part 24 and the wrapper 41 of Examples 1 to 4 above would not cause a defect in which the circumference of the roll increases during storage; and there can be provided the rod 14 (non-combustible heating-type smoking article) in which the rod circumference can be appropriately managed, as well as an electric heating-type smoking system including such a rod.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A non-combustible heating-type smoking article comprising:

a tobacco part, the tobacco part including:

a tobacco filler; and a wrapper enclosing the tobacco filler, the tobacco part having a hardness of 0.41 to 1.5 N when compressed by a length corresponding to 10% of a diameter of the tobacco part in a diameter direction of the tobacco part, the wrapper being formed by attaching two or more sheets, and the wrapper having a tensile strength of 10 to 30 N in a transverse direction crossing an axial direction of the tobacco part according to an 18 mm method.

2. The non-combustible heating-type smoking article according to claim 1, wherein:

the wrapper includes:

a first sheet made of metal, and a second sheet made of paper.

3. The non-combustible heating-type smoking article according to claim 2, wherein:

the first sheet is positioned on a side of the tobacco filler, and the second sheet is positioned on an outside.

4. The non-combustible heating-type smoking article according to claim 2, wherein the wrapper includes a third sheet made of paper and attached to a side of a second surface opposite to a first surface of the first sheet to which the second sheet is attached.

5. The non-combustible heating-type smoking article according to claim 1, wherein:

the wrapper includes:

a first sheet made of paper, and a second sheet made of paper.

6. The non-combustible heating-type smoking article according to claim 1, wherein the wrapper has a basis weight of 30 to 70 g/m$^2$.

7. The non-combustible heating-type smoking article according to claim 1, wherein the wrapper has a thickness of 35 to 80 μm.

8. The non-combustible heating-type smoking article according to claim 1, wherein the wrapper has a whiteness of 78 to 100% and an opacity of 60 to 100%.

9. The non-combustible heating-type smoking article according to claim 1, wherein the wrapper has an elongation at a break in the transverse direction of 0.1 to 8%.

10. The non-combustible heating-type smoking article according to claim 1, wherein the wrapper has a 1% stress when the wrapper is elongated by 1%, in the transverse direction of 4 to 10 N when measured by the 18 mm method.

11. The non-combustible heating-type smoking article according to claim 2, wherein:

the wrapper includes a bonding part bonding the first sheet and the second sheet, and the bonding part is made of a vinyl acetate-based emulsion adhesive or a starch glue.

12. The non-combustible heating-type smoking article according to claim 1, wherein the tobacco filler is formed by being filled with a sheet-molded material that is a sheet into which a pulverized leaf tobacco is molded and/or a cut rag of a leaf tobacco in a random orientation.

13. The non-combustible heating-type smoking article according to claim 1, wherein the tobacco part has a filling density of the tobacco filler of 0.3 to 0.5 g/cc.

14. The non-combustible heating-type smoking article according to claim 1, comprising:

a filter part configured to filter an aerosol generated from the tobacco filler; and a tubular connecting part connecting the filter part and the wrapper, the connecting part including an air vent part.

15. The non-combustible heating-type smoking article according to claim 14, wherein the filter part includes:

a first segment including a hollow part; and a solid second segment adjacent to the first segment.

16. An electric heating-type smoking system comprising:

the non-combustible heating-type smoking article according to claim 1; and a heater configured to heat the non-combustible heating-type smoking article.

* * * * *